US012429248B2

(12) United States Patent
Daniel et al.

(10) Patent No.: US 12,429,248 B2
(45) **Date of Patent: *Sep. 30, 2025**

(54) AIR HANDLING UNIT

(71) Applicant: TRANE INTERNATIONAL INC., Davidson, NC (US)

(72) Inventors: Christopher Daniel, Clarksville, TN (US); Jason William Parks, Clarksville, TN (US); Gregory L. Meeuwsen, West Salem, WI (US); Nathan Wagers, Panama City, FL (US); Chasity Webb, Panama City, FL (US); Anthony Chiles, Hopkinsville, KY (US); Gregory Edmund Beltran, Nashville, TN (US); Aaron Allison Stevens, Spring Hill, TN (US); Stephen Kowalski, Clarksville, TN (US); Jason Harpst, Clarksville, TN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/601,275

(22) Filed: Mar. 11, 2024

(65) Prior Publication Data

US 2024/0219070 A1 Jul. 4, 2024

Related U.S. Application Data

(63) Continuation of application No. 17/139,746, filed on Dec. 31, 2020, now Pat. No. 11,927,364.

(51) Int. Cl.
*F24H 3/08* (2022.01)
*F23D 99/00* (2010.01)
(Continued)

(52) U.S. Cl.
CPC ..... *F24H 3/08* (2013.01); *F23D 91/00* (2015.07); *F24H 9/06* (2013.01); *F24H 9/1854* (2013.01); *F23D 2205/00* (2013.01)

(58) Field of Classification Search
CPC ..... F22B 37/205; F24H 3/08; F24H 9/06; F24H 9/1854; F23D 91/00
(Continued)

(56) References Cited

U.S. PATENT DOCUMENTS 7,506,684 B2 3/2009 Wanni et al.
8,387,935 B2 3/2013 Khan et al.
(Continued)

OTHER PUBLICATIONS

Extended European Search Report issued in European Patent Application No. 21217753.9, dated May 30, 2022 (8 pages).

*Primary Examiner* — Vivek K Shirsat
(74) *Attorney, Agent, or Firm* — HSML P.C.

(57) ABSTRACT

An air handling unit (AHU) for a heating, ventilation, air conditioning, and refrigeration (HVACR) system includes a housing and a combustion heater disposed within the housing. The housing includes a combustion section with a first channel and a second channel. The combustion heater includes heat exchanger tubes and a tube support that supports heat exchanger tubes within the combustion section. The tube support slidably disposed in the first channel and the second channel. The combustion heater configured to be slidably removable from the AHU. An AHU for an HVACR system includes a housing with a fan section and a fan assembly disposed within the housing. The fan assembly including a pair of grooves slidably disposed on a pair of rails of the housing. The fan assembly configured to be both slidably removable from the AHU and liftably removable from the AHU.

18 Claims, 17 Drawing Sheets

(51) Int. Cl.
*F24H 9/06* (2006.01)
*F24H 9/1854* (2022.01)

(58) Field of Classification Search
USPC ..... 126/110 D, 99 R, 116 R; 110/325; 248/68.1
See application file for complete search history.

(56) References Cited

U.S. PATENT DOCUMENTS

| | | | | |
|---|---|---|---|---|
| 9,683,735 | B2 * | 6/2017 | Bowyer | F16L 3/223 |
| 11,927,364 | B2 * | 3/2024 | Daniel | F24F 3/001 |
| 2002/0092516 | A1 * | 7/2002 | Gierula | F24H 3/087 126/110 R |
| 2005/0194003 | A1 | 9/2005 | Paulsen et al. | |
| 2012/0085334 | A1 | 4/2012 | Beck et al. | |
| 2015/0285516 | A1 | 10/2015 | Hanks et al. | |
| 2016/0131396 | A1 * | 5/2016 | Hanks | F28F 9/013 126/116 R |
| 2016/0209055 | A1 | 7/2016 | Gedcke et al. | |
| 2016/0216004 | A1 | 7/2016 | Bruton et al. | |

* cited by examiner

AIR HANDLING UNIT

FIELD

This disclosure relates generally to heating, ventilation, air conditioning, and refrigeration ("HVACR") systems. More specifically, this disclosure relates to an air handling unit ("AHU") used in HVACR systems.

BACKGROUND

HVACR systems are generally used to heat, cool, and/or ventilate an enclosed space (e.g., an interior space of a commercial building or a residential building, an interior space of a refrigerated transport unit, or the like). An AHU is part of a HVACR system that is used to regulate and circulate air. A ductwork ventilation system can be connected to the AHU and directs conditioned air from the AHU to the enclosed space and air from the conditioned space to the AHU. The AHU can include a housing, fan(s), and heat exchanger(s). The heat exchanger be a combustion heater that directs combustion gases through heat exchanger tubes to heat air flowing past the heat exchanger tubes as it flows through the AHU. The AHU can also include one or more components of a refrigerant circuit of the HVACR system used to cool the air (e.g., the condenser, the evaporator, and the like).

BRIEF SUMMARY

A heating, ventilation, air conditioning, and refrigeration ("HVACR") system can be utilized to heat and/or cool a conditioned space. The HVACR system can utilize an air handling unit ("AHU") to regulate and circulate air. The air handling unit receives air (e.g., air from the conditioned space, ambient air, and the like) and discharges conditioned air (e.g., heated, cooled, dehumidified, filtered, and the like) that is supplied to the conditioned space.

In an embodiment, the AHU includes a housing containing a combustion section and a combustion heater that disposed within the housing. The housing includes a first side with an opening for the combustion section. The combustion section has a first side wall with a first channel and a second side wall with a second channel. The combustion heater includes an end plate, heat exchanger tubes, and a tube support. The heat exchanger tubes extend from the end plate and into the combustion section. The tube support is slidably disposed in the first channel and the second channel and supports the heat exchanger tubes within the combustion section. The tube support is configured to slidably move through the first channel and the second channel in a first direction that moves the combustion heater through the opening in the housing.

In an embodiment, the tube support is configured to slidably move in the first direction through and from the first channel and the second channel such that the combustion heater is entirely moved through the opening in the housing.

In an embodiment, the first channel and the second channel each have an open end. The tube support has a retaining member slidably disposed in the first channel and the second channel. The moving the retaining member in the first direction through the open ends of the first channel and the second channel is configured to separate the combustion heater from the housing.

In an embodiment, the first channel and the second channel are configured to not limit the movement of the tube support in the first direction.

In an embodiment, the tube support includes a retaining member, the retaining member having a first end disposed in the first channel and a second end disposed in the second channel.

In an embodiment, the tube support includes a vertical support and a plurality of contact arms. The vertical support extends from the retaining member and each of the contact arms extends from the vertical support. Each of the heat exchanger tubes rests on a respective one of the plurality of contact arms. In an embodiment, each of the contact arms extends between a vertically adjacent pair of the heat exchanger tubes.

In an embodiment, the tube support is configured to vertically support the heat exchanger tubes within the combustion section.

In an embodiment, the first channel and the second channel are configured to restrict vertical movement of the tube support while allowing the tube support to move in the first direction.

In an embodiment, the first channel and the second channel are formed by a pair of brackets provided on opposite walls of the combustion section.

In an embodiment, the AHU includes one or more support clips for the heat exchanger tubes. Each of the support clips is fitted around a vertically adjacent pair of the heat exchanger tubes.

In an embodiment, an AHU includes a housing containing a fan section and a fan assembly disposed in the combustion section. The housing includes a first side with a first opening for the combustion section, a top side with a second opening for the combustion section, and a pair of rails disposed in the combustion section. The fan assembly includes one or more fans and a pair of grooves slidably disposed on the rails of the housing. The fan assembly is configured to be both slidably removable from the AHU through the first opening and liftably removable from the AHU through the second opening.

In an embodiment, the fan assembly is configured to be slidable along the pair of rails in a first direction to move the fan assembly through the first opening. The fan assembly is also configured to be liftable from the pair of rails in a second direction to move the fan assembly through the second opening. In an embodiment, the second direction is an upward direction.

In an embodiment, the pair of grooves includes a first groove and a second groove. The first groove is disposed on a first side of the fan assembly. The second groove is disposed on a second side of the fan assembly opposite to its first side.

In an embodiment, the grooves face downward and the rails project upwards.

In an embodiment, the fan(s) in the fan assembly is a radial fan.

In an embodiment, the AHU also includes a heater disposed in the fan section, the fan(s) of the fan assembly configured to blow air towards the heater.

BRIEF DESCRIPTION OF THE DRAWINGS

Both described and other features, aspects, and advantages of an air handling unit will be better understood with the following drawings:

FIG. 7A is a schematic rear perspective view showing the combustion heater in an installed position, according to an embodiment. FIG. 7B is a schematic rear perspective view showing the combustion heater in a partially removed position, according to an embodiment. FIG. 7C is a schematic rear perspective view showing the combustion heater in a completely removed position, according to an embodiment.

FIG. 13A is a rear perspective view of the ABU with the fan assembly in a partially slidably removed position, according to an embodiment. FIG. 13B is a rear perspective view of the ABU with the fan assembly in a completely slidably removed position, according to an embodiment. FIG. 13C is a schematic rear perspective view showing the fan assembly in a completely liftably removed position, according to an embodiment.

Figure 1:
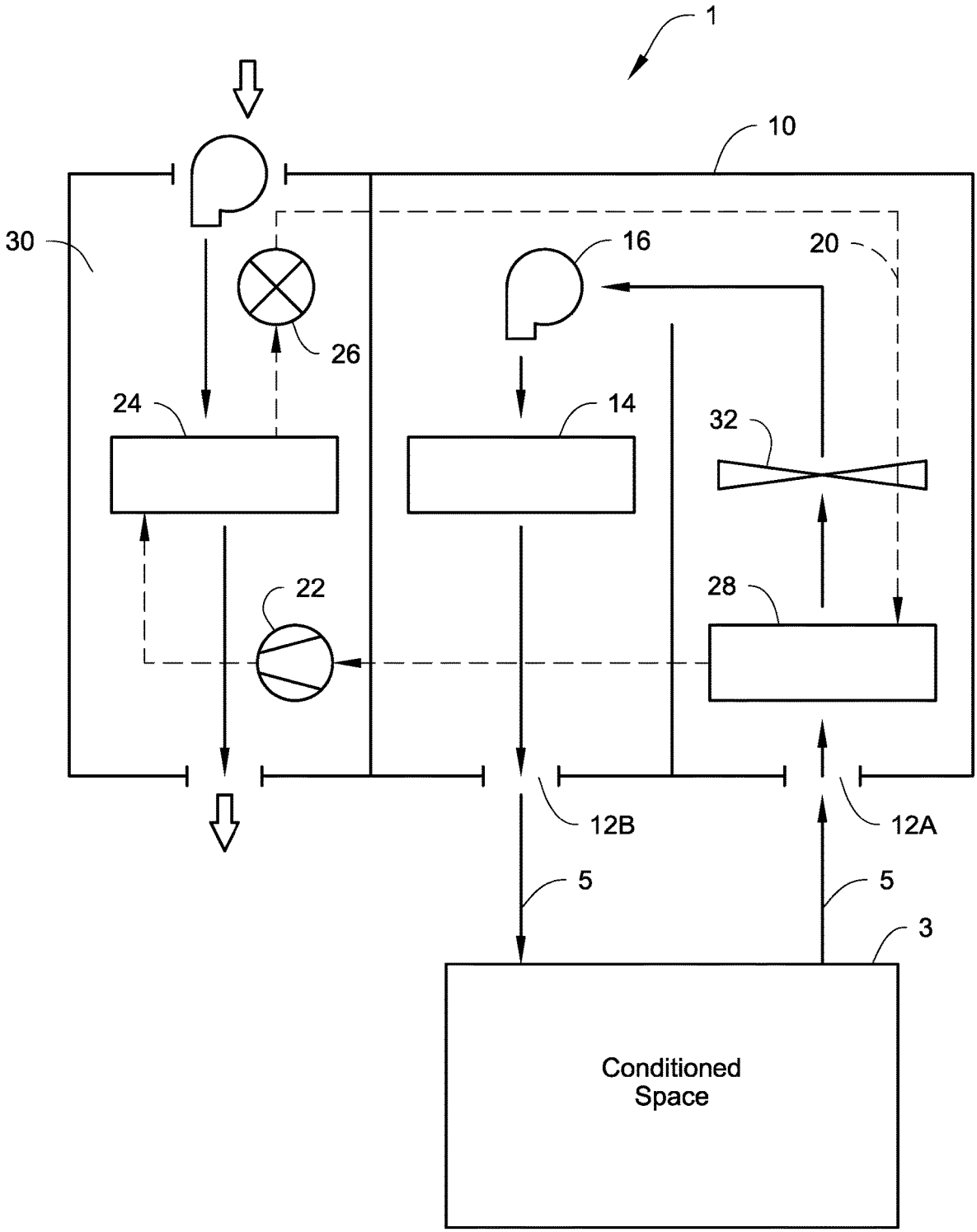
FIG. 1 is a schematic diagram of an embodiment of a heating, ventilation, air conditioning, and refrigeration ("HVACR") system.

Like references in the drawings refer to like features.

DETAILED DESCRIPTION

FIG. 1 is a schematic diagram of an embodiment of a heating, ventilation, air conditioning, and refrigeration ("HVACR") system 1. The HVACR system 1 is configured to condition (e.g., heat, cool, dehumidify, and the like) a conditioned space by supplying conditioned air to the conditioned space 3. The HVACR system can include a ductwork ventilation system 5 and an air handling unit ("AHU") 10. The AHU 10 is connected to the ductwork ventilation system 5 that is configured to distribute the conditioned air discharged from the AHU 10 to the conditioned space 3. The ductwork ventilation system 5 can also return air from the conditioned space 3 back to the AHU 10.

The air to be conditioned flows through the AHU 10 from an inlet 12A to the outlet 12B of the AHU 10. The air is conditioned as it flows from the inlet 12A to the outlet 12B of the AHU such that conditioned air is discharged from the outlet 12B. In an embodiment, the AHU 10 is configured to be capable of cooling and heating the air as it flows through the AHU 10. In a heating mode, the AHU 10 heats the air as it flows through the AHU 10. In a cooling mode, the AHU 10 cools the air as it flows through the AHU 10.

The HVACR system 1 can include a refrigerant circuit 20 to provide cooling. The refrigerant circuit 20 can include a compressor 22, a condenser 24, an expander 26, and an evaporator 28. In an embodiment, the heat transfer circuit 1 can be modified to include additional components, such as, for example, an economizer heat exchanger, one or more valve(s), sensor(s) (e.g., a flow sensor, a temperature sensor, and the like), a receiver tank, or the like. The components of the heat transfer circuit 1 are fluidly connected as shown by the dashed lines in FIG. 1.

The refrigerant circuit 20 operates by known principles of refrigerant compression and expansion to provide cooling. Working fluid (e.g., a refrigerant, a refrigerant blend, or the like) is compressed by the compressor 10, cooled in the condenser 24, and then expanded in the expander 26. The expansion causes the working fluid to cool. The cool working fluid then flows through the evaporator 28. The air flowing through the AHU 10 from the inlet 12A to the outlet 12B flows through the evaporator 28 separately from the working fluid. The cooler working fluid absorbs heat from the passing air and cools the air. The evaporator 28 cooling the air passing by/through the evaporator 28.

As the air flows through the AHU 10 from its inlet 12A to its outlet 12B, the air flows through an evaporator 28 and a combustion heater 14. In a heating mode, the AHU 10 operates the combustion heater 14 to heat the passing air. In a cooling mode, the AHU 10 can operate the refrigerant circuit 10 for the evaporator 28 to cool the passing air. The AHU 10 also includes a fan 16 to generate air flow through the AHU 10 from its inlet 12A to its outlet 12B.

As shown in FIG. 1, the AHU 10 can contain components of the refrigerant circuit 20 other than evaporator 28. The AHU 10 can include a condenser section 30 that utilizes air to cool one or more components of the refrigerant circuit 20. In an embodiment, the AHU 10 can be configured to operate in a heat pump mode in which the evaporator 28 instead operates as a condenser that heats the air as it flows past. For example, the AHU 10 can include one or more fan(s) 32 that blow ambient air through the condenser 24 of the refrigerant circuit 20 to cool the working fluid flowing through the condenser 24. The compressor 20 can also be disposed in the condenser section 30. In an embodiment, the other components of the refrigerant circuit 20 may be located external to the AHU 10 (e.g., in a different AHU, within a building, and the like). The AHU 10 may also include other components for conditioning the air. The AHU 10 may include, for example but not limited to, an air filter 32, dehumidifier, humidifier, and the like.

Figure 2:
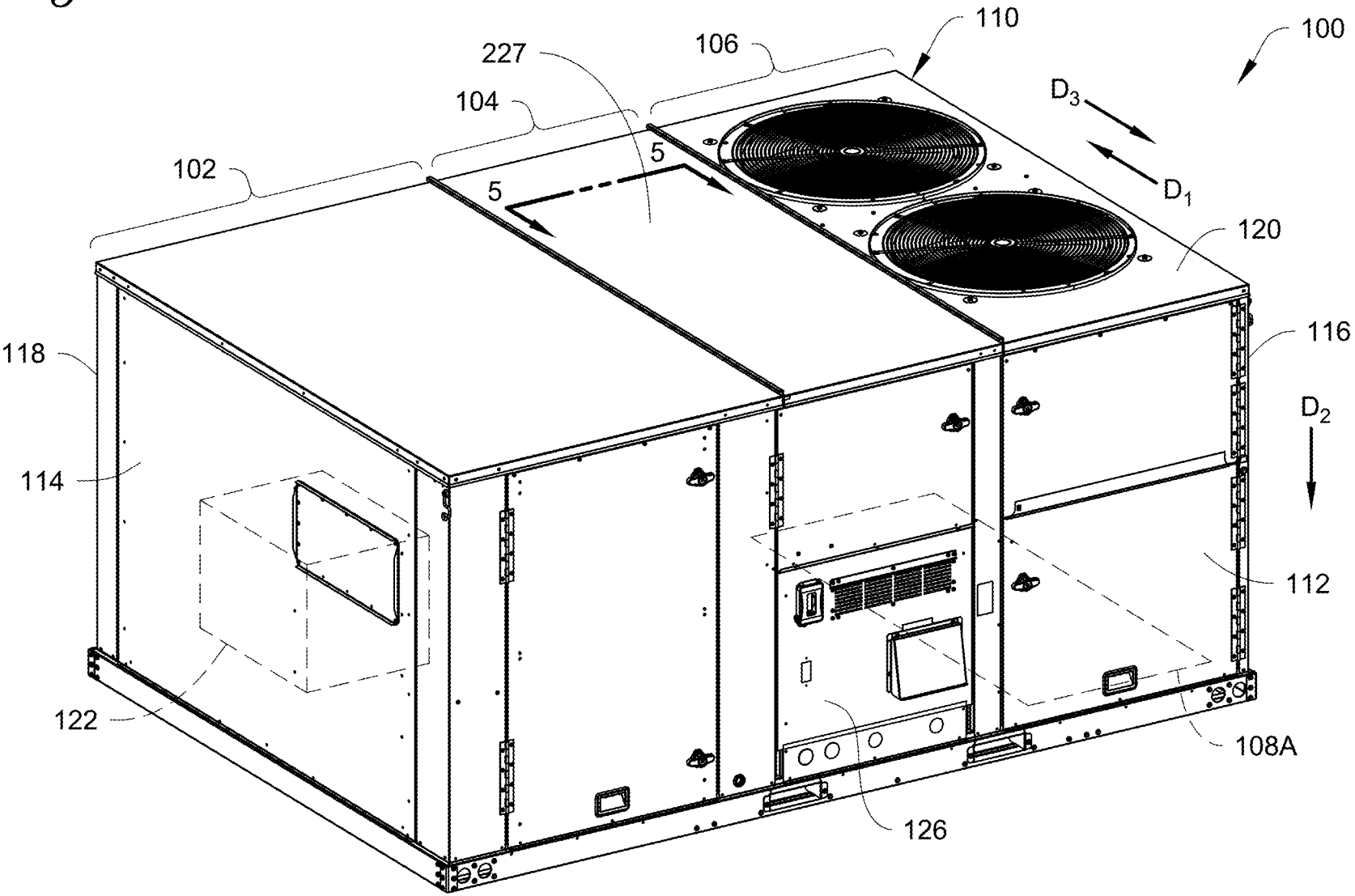
FIG. 2 is a front perspective view of an AHU for an HVACR system.

FIG. 2 is a front perspective view of an embodiment of an air handling unit ("AHU") 100 used in an HVACR system. In an embodiment, the AHU 100 can be the AHU 10 in the HVACR 1 shown in FIG. 1. A ductwork ventilation system (e.g., the ductwork ventilation system 5 in FIG. 1) can be connected to the AHU 100 that distributes conditioned air to a conditioned space (e.g., the conditioned space 5 in FIG. 1) and then returns the air to the AHU 100 for conditioning. The AHU 100 includes a return inlet section 102, a fan section 104, and a condensing section 106. The AHU 100 includes an inlet 108A and an outlet 108B (obscured in FIG. 1; shown in FIG. 2) for the air returning from and being provided to a conditioned space (e.g., the conditioned space 3 in FIG. 1). The inlet 108A and outlet 108B can be located in the bottom of the AHU 100 (e.g., the bottom of the housing 110). The sections 102, 104, 106 each have a depth that extends in a first direction $D_1$ and a height that extends in a second direction $D_2$. For example, the second direction $D_1$ is perpendicular to the first direction $D_1$. The sections of the AHU 100 are discussed in more detail below.

The AHU 100 includes a housing 110 with a plurality of sides. As shown in FIG. 1, the AHU includes a first side 112, a second side 114, a third side 116 (obscured in FIG. 2), a fourth side 118 (obscured in FIG. 2), and a fifth side 120. In FIG. 2: the first side 112 is the front side, the second side 114 is the left side, the third side 116 is the right side, the fourth side 118 is the rear side, and the fifth side 120 is the top side of the AHU 100. The sides of the housing 110 have panels (e.g., panel 126 of the front side 112, panel 227 of the top side 120, and the like). In an embodiment, one or more panels can be provided on each side. The panels can be opened to access the interior and one or more interior components of the AHU 100.

The air enters the AHU 100 through the inlet 108A and is then discharged as conditioned air from the AHU 100 from the outlet 108B. The return inlet section 102 includes the inlet 108A. The fan section 104 includes the air outlet 108B. The air flows through the inlet 108A into the return inlet section 102, from the inlet section 102 to the fan section 104, through the fan section 104 to the outlet 108B, and is then discharged from the AHU 100 through the outlet 108B. The air is conditioned as it flows through the AHU 100 from the inlet 108A to the outlet 108B. For example, the air is conditioned within the return inlet section 102 and the fan section 104.

In a heating mode, combustion gases are used to heat the air as it flows through the fan section 104. In such a configuration, the fan section 104 can also be referred to as a combustion section. In an embodiment, the return inlet section 102 includes a cooling heat exchanger 122 of the HVACR system (e.g., the evaporator 28 in FIG. 1). In a cooling mode, air flows through the cooling heat exchanger 122 as it flows through the return inlet section 102 and is cooled by a colder fluid (e.g., expanded refrigerant, chiller water, and the like) separately flowing through the cooling heat exchanger 122. The return inlet section 102 may also be referred to as a cooling section. The condenser section 106 can contain a condenser of the refrigerant circuit of the HVACR system (e.g., condenser 24 in FIG. 1). The condenser section 106 circulates air past the condenser to cool the working fluid as it flows through the condenser. In an embodiment, the HVACR system may utilize a condensing section 106 that is provided in separate second AHU (not shown). For example, the AHU 100 in such an embodiment would include the return inlet section 102 and the fan section 104 without the condensing section 106.

Figure 3:
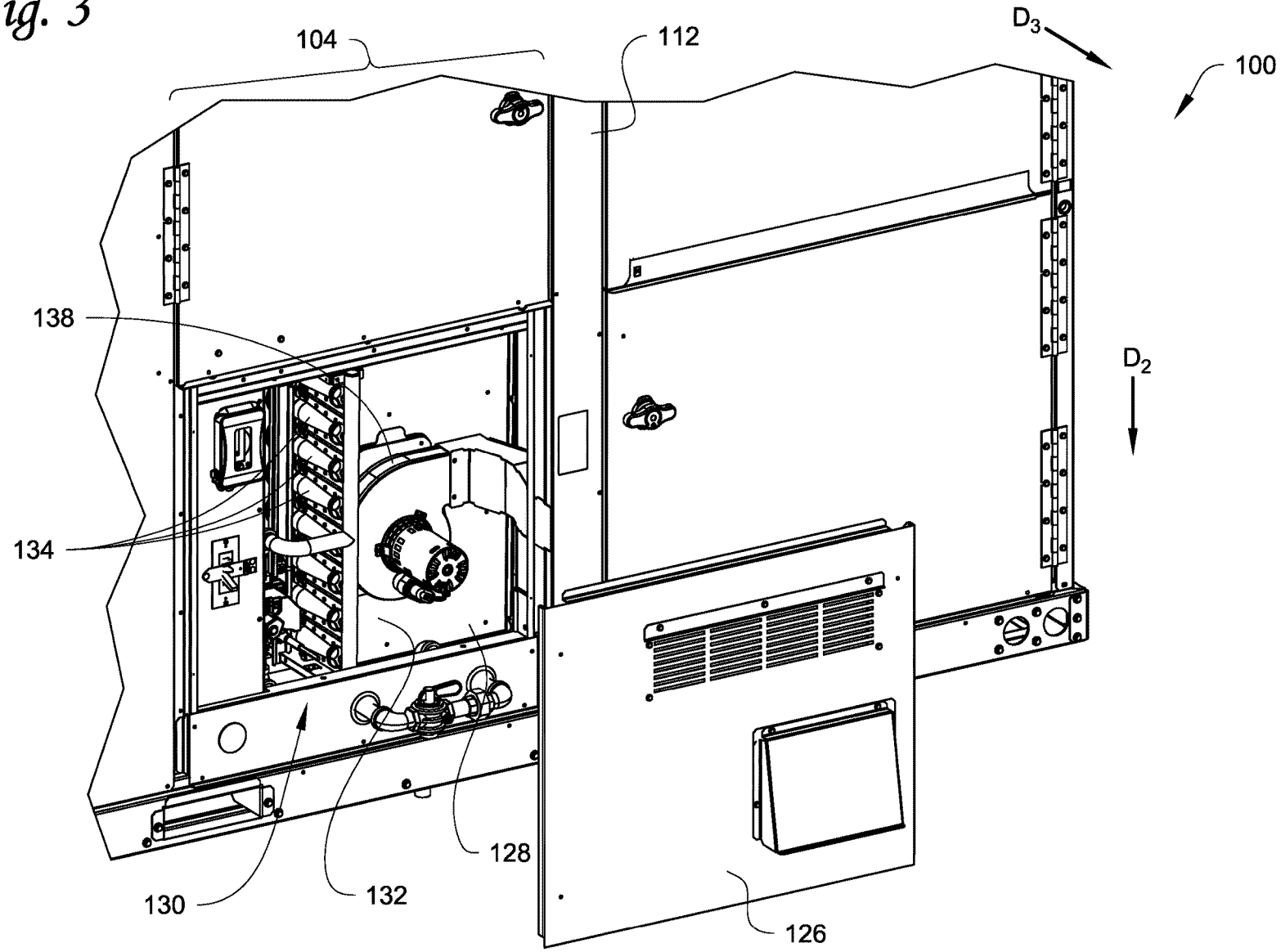
FIG. 3 is partial front perspective view of a front side of the AHU in FIG. 2, accordingly to an embodiment.

FIG. 3 is partial front perspective view of the front side 112 of the AHU 100. A panel 126 of the front side 112 is opened and removed in FIG. 3. The panel 126 covers an opening 128 in the housing 110 for the fan a combustion heater 130 that extends into the fan section 104 of the AHU 100. In a heating mode, the combustion heater 130 heats the air as it flows through the fan section 104.

The combustion heater 130 includes an end plate 132, igniters 134, a plurality of heat exchanger tubes 136 (obscured in FIG. 2; e.g., shown in FIG. 4), and a fan 138. The igniters 134 and fan 137 are provided on the end plate 132. The heat exchanger tubes 136 are disposed in the airflow path through the fan section 104. The igniters 134 ignite an air and fuel mixture flowing into the heat exchanger tubes 136. The air and fuel mixture can be ignited before entering the heat exchanger tubes 136 or as the mixture flows into the heat exchanger tubes 136. As the hot combustion gas flows through the heat exchanger tubes 136, the air flowing through the fan section 104 absorbs heat from the hot combustion gas through the walls of the heat exchanger tubes 136. The air is heated as it flows through the fan section 104 and past the heat exchanger tubes 136. The fan 138 directs the air and fuel mixture and/or its resulting combustion gas to flow through the heat exchanger tubes 136. For example, as shown in FIG. 3, the fan 138 can provide suction to the outlets of the heat exchanger tubes 136 to generate flow through the heat exchanger tubes 136. In another embodiment, the fan 138 may be upstream of the ignitors 134 and configured to blow the air and gas mixture to the ignitors 138. The fan 138 can be configured to blow the cooled combustion gases out of the AHU 100.

The combustion heater 130 is configured to be slidably removable from the AHU 100. The combustion heater 130 is removed from the AHU 100 by moving through the opening 128 in the housing 110 in a direction $D_3$. For example, the combustion heater 130 may be removed by being pulled through the opening 128 in the direction $D_3$. The slidable removal of the combustion heater 130 is described in more detail below.

The removal of the combustion heater 130 includes fluidly and electrically decoupling the combustion heater 130 from the rest of the AHU 100. For example, fluidly decoupling the combustion heater 130 can include decoupling the combustion heater 130 from the piping of the AHU 100 that supplies the air and fuel, separately or as a mixture, to the combustion heater 130. Fluidly decoupling the combustion heater 130 can also include decoupling the exhaust outlet of the combustion heater 130 (e.g., the outlet vent of the fan 138) from the housing 110. Electrically decoupling the combustion exchanger unit 130 from the AHU 100 can include disconnecting one or more electrical wires for the combustion heater 130 (e.g., power supply wire(s), sensor signal wire(s), and the like).

In an embodiment, one or more retaining structures, such as fasteners (e.g., screws, bolts, clamps, and the like), flexible tabs, and the like, may be provided to secure the end plate 132 to the housing 110 so as to prevent minor movement and/or accidental movement of the combustion heater 130. In such an embodiment, the removal of the combustion heater 130 can include removing such fasteners (e.g., flexing the flexible tab(s), unscrewing the screw(s) and/or bolt(s), removing clamp(s), and the like) to allow the movement and removal of the combustion heater 130.

Figure 4:
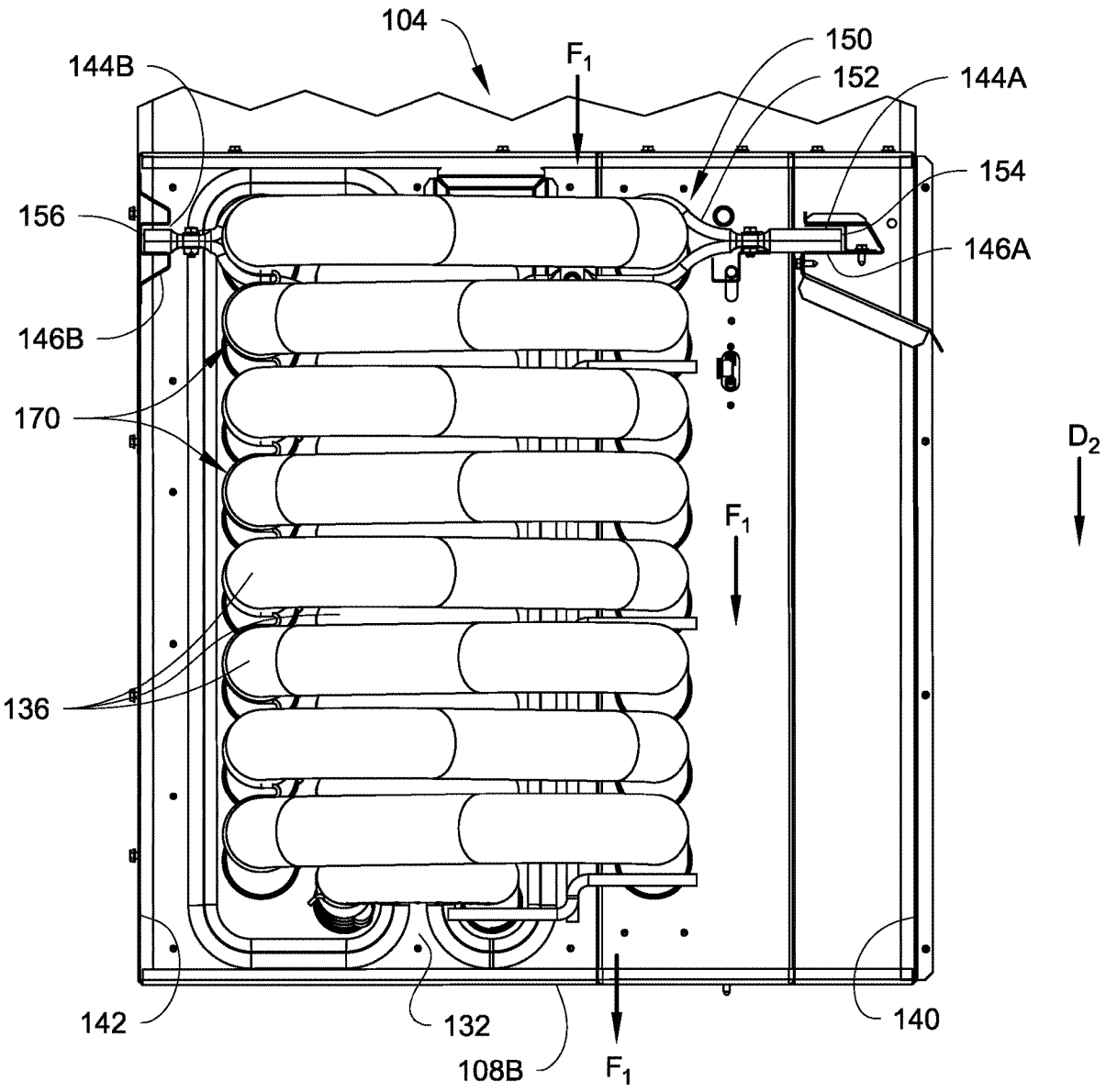
FIG. 4 is a partial rear view of a combustion heater in a fan section of the AHU in FIG. 2, according to an embodiment.

FIG. 4 shows a partial rear view of the interior of the AHU 100. In particular, FIG. 4 illustrates the combustion heater 130 disposed in the fan section 104. The arrows $F_1$ illustrate the flow of air through the fan section 104 past the heat exchanger tubes 136 and out through the outlet 108B. The heat exchanger tubes 136 generally extend in a direction perpendicular to the flow of air through the fan section 104. For example, the heat exchanger tubes 136 extend from the end plate 132 of the combustion heater 130 in the direction $D_3$ that extends from the front to the back of the AHU 100, while the air flows in a direction $D_2$ that extends from the top to the bottom of the AHU 100.

Fan section 104 includes a pair of opposing side walls 140, 142. The side walls separate the fan section 104 from the other sections 102, 106 of the AHU 100. As shown in FIG. 4, the side walls 140, 142 are internal walls of the housing 110 of the AHU 100. The first side wall 140 is an internal wall between the fan section 104 and the return inlet section 102. The second side wall 142 is between the fan section 104 and the condenser section 106. The side walls 140, 142 can help direct the air across the heat exchanger tubes 136 and towards the outlet 108B in the bottom of the fan section 104. The heat exchanger tubes 136 disposed between the side walls 140, 142. The side walls 140, 142 can extend from the front of the AHU 100 to the rear of the AHU 100 (e.g., from the front side 112 to the rear side 118) and from the bottom of the AHU 100 to the top of the AHU (e.g., from the bottom of the AHU to the top side 120). The fan section 104 is formed by the front side 112, the rear side 118, and the top side 120 of the housing 110 and the side walls 140, 142.

As shown in FIG. 4, the side walls 140, 142 each have a channel 144A, 144B. The first side wall 140 includes a first channel 144A and the second side wall 142 includes a second channel 144B. The channels 144A, 144B disposed opposite to each other in the fan section 104. For example, the first channel 144A has a longitudinal opening that faces the second side wall 142, and second channel 144A has a longitudinal opening that faces the first side wall 140. In combination, the two channels 144A, 144B form a slot across the fan section 104. As shown in FIG. 4, the channels 144A, 144B face each other across the combustion section. Each of the channels 144A, 144B extends along its respective side wall 140, 142 and away from the front side 112 of the housing 112 (e.g., in the direction $D_1$ in FIG. 2).

As shown in FIG. 4, the channels 144A, 144B can be provided using a pair of brackets 146A, 146B. A first bracket 146A is affixed to the first side wall 140, and a second bracket 146B is affixed to the second side wall 142. For example, the first bracket 146A is affixed to the surface of the first wall 140 and the second bracket 146B is affixed to the surface of the second wall 142. The first and second brackets 146A, 146B can respectively form the first and second channels 144A, 144B.

The combustion heater 130 includes a slidable tube support 150 that supports the heat exchanger tubes 136 within the interior space of the fan section 104. The slidable tube support 150 is configured to be slidable along in the depth direction $D_1$ of the fan section 102 for moving the combustion heater 130 through the opening 128 in the housing 110 (shown in FIG. 3). The tube support 150 is slidable/movable relative to the housing 110. For example, this allows a technician (manually or machine assisted) to pull on the combustion heater 130 in the direction $D_3$ to slide the entire combustion heater 130 through the opening 128 in the housing 110. In an embodiment, the opening 128 in the housing 110 is enlarged to allow removal of the combustion heater 130 by removing additional panels of the front side 112 of the housing 110. The slidable tube support 150 can be used to partial remove the combustion heater 130 from the housing 110 (e.g., sliding the combustion heater 130 only partway through the opening 128) or to completely remove the combustion heater 130 from the AHU 100 and the housing 110. For example, the partial removal may be used by a technician to allow for easier repair of the combustion heater 130, while the full removal can be used for larger repairs and/or for replacement of the combustion heater 130.

The slidable tube support 150 includes a retaining member 152 that is slotted into the channels 144A, 144B. The retaining member 152 is slidably disposed in the channels 144A, 144B. The retaining member 152 extends from the first channel 144A to the second channel 144B. When the combustion heater 130 is installed in the AHU 100, the retaining member 152 extends between the first side wall 140 the second side wall 142. The retaining member 152 has a first end 154 and an opposite second end 156. The first end 154 is disposed in the first channel 144A and the second end 156 is disposed in the second channel 144B. As the retaining member 152 is vertically trapped in the channels 144A, 144B, movement of the retaining member 152 in the vertical direction (e.g., in direction $D_2$, in the opposite direction of the direction $D_2$) is prevented/restricted while being free to move along the length of the channels 144A, 144B (e.g., into or out of the drawing in FIG. 4, in direction $D_1$ in FIG. 2, in direction $D_3$ in FIG. 2). The channels 144A, 144*b* configured to limit vertical movement of the tube support 150 while not limiting the movement along the first direction $D_1$.

The retaining member 152 is rotatable within the channels 144A, 144B. The combustion heater 130 is configured to pivot on the retaining member 152. The retaining member 152 acts as the rotational axis for the pivoting of the combustion heater 130. For example, the combustion heater 130 can be swung forwards towards the front side 112 (e.g., in direction $D_3$) to pivot the combustion heater 130 and angle the combustion heater 130 at an incline towards the front side 112 (e.g., angled upwards in the direction $D_3$). For example, the combustion heater can be swung backwards towards the rear side 118 (e.g., in direction $D_1$) to pivot the combustion heater 130 and angle the combustion heater 130 to decline towards the front side 112 (e.g., angled downwards in the direction $D_3$). The channels 144A, 144B and are configured to allow sliding of the retaining member 152 through the length of the channels 144A, 144B while restricting/preventing vertical movement. The retaining member 152 is configured to only be removable from the channels 144A, 144B sliding through the open ends of the channels 144A, 144B. The channels 144A, 144B are configured so that the retaining member 152 cannot be vertically removed from the channels 144A, 144B (e.g., prevents upward and downward pushing from removing of the retaining member 152 from the channels 144A, 144B). As shown in FIG. 4, the combustion heater 130 can also include a plurality of adjacent tube support clips 170. The support clips 170 are discussed in more detail below.

Figure 5:
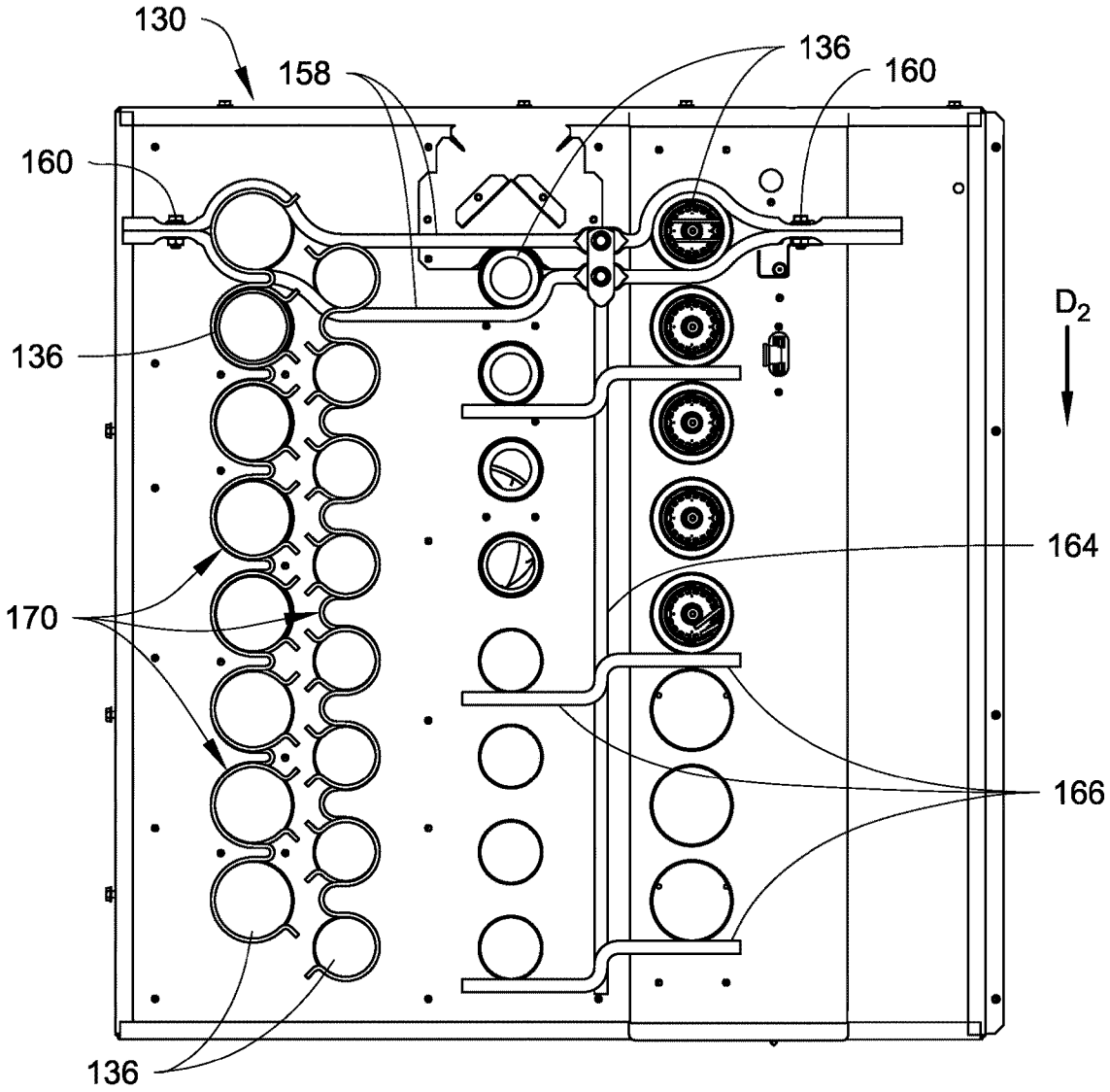
FIG. 5 is a partial vertical cross-sectional view of the combustion heater of the AHU as indicated in FIG. 2, according to an embodiment.

FIG. 5 is a partial vertical cross-sectional view of the combustion heater 130 as indicated in FIG. 2, according to an embodiment. For example, FIG. 5 illustrates the interaction between the slidable tube support 150 and the heat exchanger tubes 136. The retaining member 152 is fastened to one or more of the heat exchanger tubes 136 to prevent the retaining member 152 from moving relative to the heat exchanger tubes 136. As shown in FIG. 5, the retaining member 152 can be fastened around a group of the heat exchanger tubes 136. The retaining member 152 can include a pair of brackets 158 that are fastened together with fasteners 160 (e.g., screws, bolts, clamps, and the like). One bracket 158 disposed above the group of heat exchanger tubes 136 and the second bracket 158 disposed below the group of heat exchanger tubes 136. The heat exchanger tubes 136 being pinched between the fastened together pair of brackets 158. The group of heat exchanger tubes 136 held between the pair of brackets 158. It should be appreciated that the slidable tube support 150 can be prevented from sliding along the heat exchange tubes 136 in a different manner. For example, the slidable tube support 150 may be affixed to the heat exchange tubes 136 via welding, fasteners, or the like, or the heat exchanger tubes 136 may have exterior projections that prevent the tube support 150 from sliding along the outsides of the heat exchanger tubes 136.

The slidable tube support 150 also includes a vertical support 164 and a plurality of contact arms 166. As shown in FIG. 5, the vertical support 164 extends from the retaining member 152, and the contact arms 166 each extend outward from the vertical support 164. For example, the contact arms 166 branch off from the vertical support 164. The contact arms 166 are connected to the retaining member 152 by the vertical support 164. For example, the vertical support 164 is directly connected to the retaining member 152, and the contact arms 166 are each directly connected to the vertical support 164.

The vertical support 164 extends along a column of the heat exchanger tubes 136. As shown in FIG. 5, the vertical support 164 can extend between two adjacent columns of the heat exchanger tubes 136. In an embodiment, the vertical support 164 extend along an outside column of heat exchanger tubes 136.

The heat exchanger tubes 136 rest on the contact arms 166. Each heat exchanger tube 136 can rest on a respective contact arm 166. In an embodiment, the contact arms 166 help to hold the heat exchanger tubes 136. For example, the bottom surface of a heat exchanger tube 136 rests on the upper surface of its respective contact arm 166. The contact arms 166 are prevented from vertically moving by the retaining member 152 being disposed/slotted in the channels 144A, 144B. The contact arms 166 vertically remain in place and provide a support surface for resting the heat exchanger tubes 136. Each contact arm 166 prevents/limits the downward movement of its respective heat exchanger tube 136.

In an embodiment, one or more of the exchanger tubes 136 may be contacted by just a single contact arm 166. For example, the heat exchanger tubes 136 in the rightmost column of heat exchanger tubes 136 in FIG. 5 are each in contact with multiple contact arms 166. In an embodiment, one or more of the heat exchanger tubes 136 may be contacted by multiple contact arms 166. The heat exchanger tube 136 can rest on a first contact arm 166 as discussed above. A second contact arm 166 can contact the top of the heat exchanger tube 136 and be configured to prevent upward movement of the heat exchanger tube 136. For example, the second contact arm 166 can also provide support to the upper adjacent heat exchanger tube 136. The upper adjacent heat exchanger tube 136 rests on the upper surface of the second contact arm 166.

The combustion heater 130 shown in FIGS. 4 and 5 has a single tube support 140. However, the combustion heater 130 in an embodiment may include multiple of the tube support 140. The heat exchanger tubes 136 are supported within the AHU 100 by only the end plate 130 and the one or more tube support(s) 140.

Figure 6:
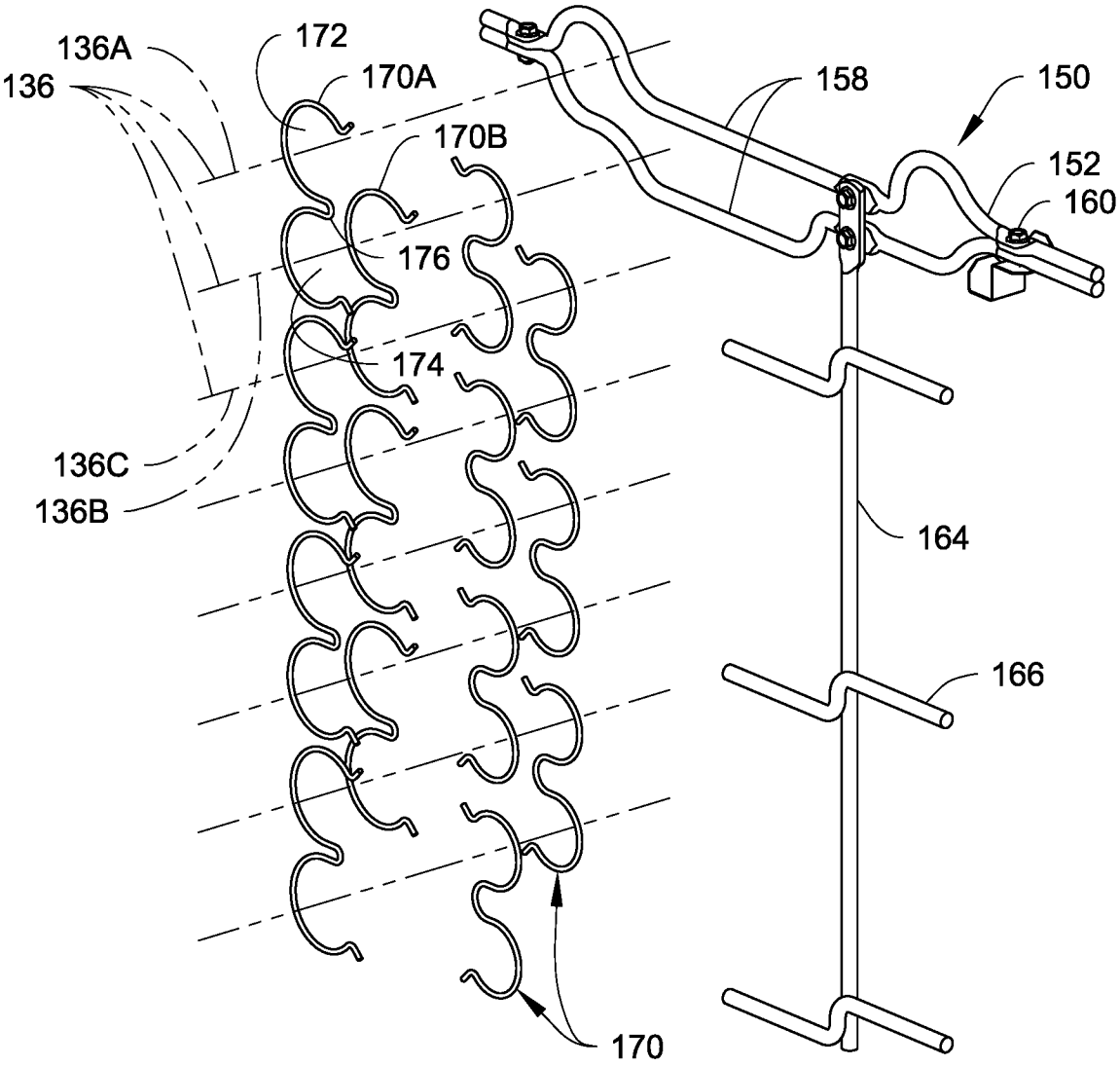
FIG. 6 is a perspective view of the slidable tube support 150 and tube support clips for a combustion heater of an AHU, according to an embodiment.

FIG. 6 shows a perspective view of the slidable tube support 150 and the adjacent tube support clips 170, according to an embodiment. Dashed lines are provided in FIG. 6 to illustrate the positions of the leftmost column of heat exchanger tubes 136. The support clips 170 can help ensure a desired vertical spacing is maintained between adjacent heat exchanger tubes 136 (e.g., vertically adjacent heat exchanger tubes 136).

Each support clip 170 includes a first opening 172 and a second opening 174. The first opening 172 is configured to fit around a first heat exchanger tube 136, and while second opening 174 is configured to fit around a second adjacent heat exchanger tube 136. In an embodiment, the first opening 172 and second opening 174 are configured to snap fit around their respective heat exchanger tube 136. The support clip 170 also has a middle portion 176 disposed between its adjacent pair heat exchanger tubes 136. The middle portion 176 is configured to restrict movement between the adjacent heat exchanger tubes 136. For example, the middle portion 176 is a bent portion that acts as a spring that biases the adjacent heat exchanger tubes 136 to a predetermined relative vertical position (e.g., biased to a set predetermined distance between the adjacent heat exchanger tubes 136).

Each support clip 170 in the plurality of adjacent tube support clips 170 couples a different set of heat exchanger tubes. The support clips 170 can overlap at least one heat exchanger tube 136. For example, a first support clip 170A couples a first heat exchanger tube 136A to a second heat exchanger tube 136B, and a second support clip 170B couples the second heat exchanger tube 136B to a third heat exchanger 136B.

The slidable tube support 150 in FIGS. 4-6 includes a contact arm 166 for each heat exchanger tube 136. However, the sliding support 150 in an embodiment may not have a contact arm 166 for each heat exchanger tube 136. In such an embodiment, the support clip(s) 170 can be used to couple a heat exchanger tube 136 without a contact arm 166 to a heat exchanger tube 136 with a contact arm 166. The slidable tube support 150 can provide support to the heat exchanger tube 136 without a contact arm 166 via the supported heat exchanger tube 136 and said support clip(s) 170.

Figure 7A:
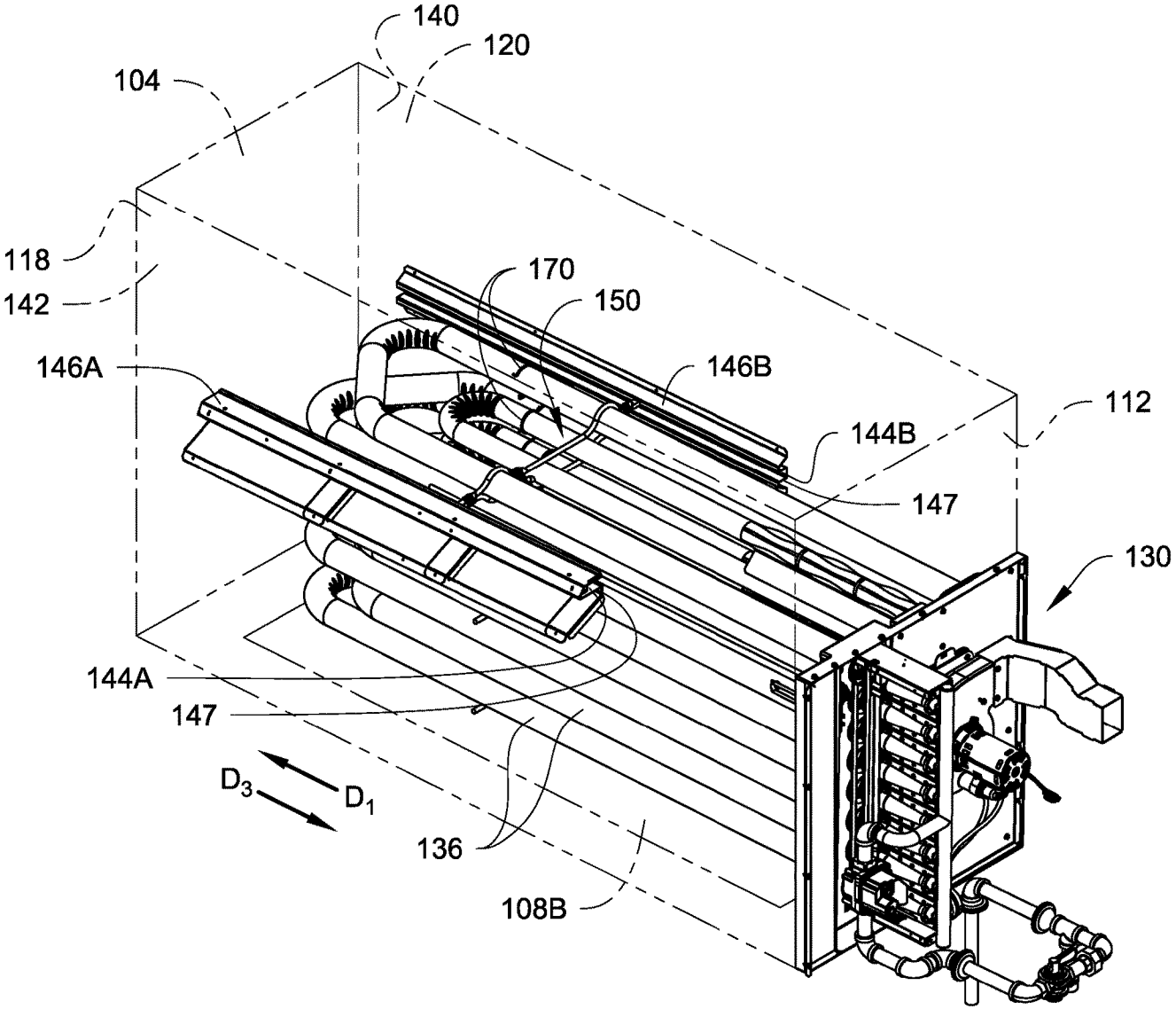
FIGS. 7A-7C show a combustion heater of the ABU in FIG. 2 in various positions.
Figure 7B:
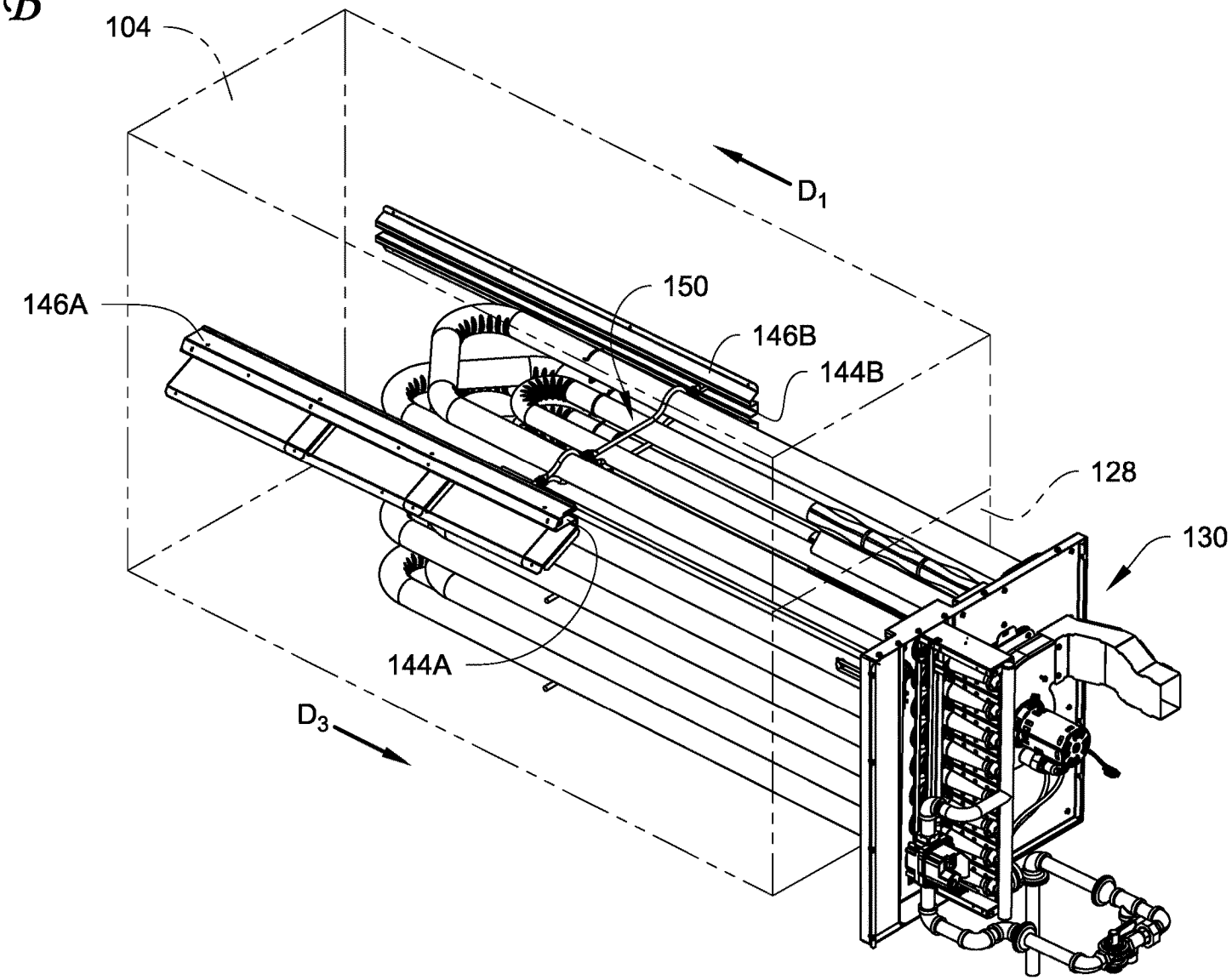
Figure 7C:
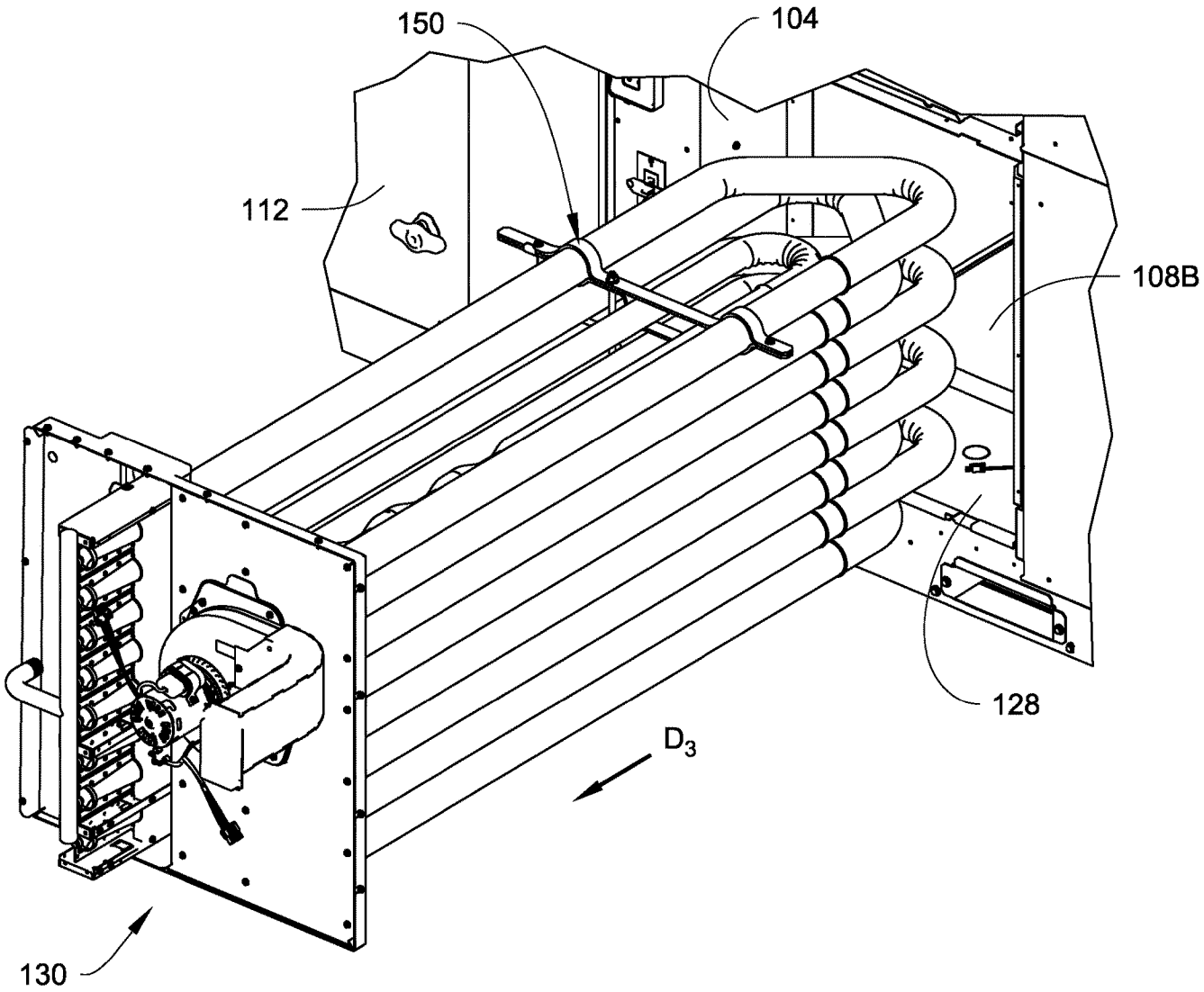

FIGS. 7A-7C show the combustion heater 130 in various positions when being removed from the AHU 100. Dashed lines are provided in FIGS. 7A and 7B to illustrate the sides of the housing 110 that form the fan section 104 of the AHU 100.

FIG. 7A shows the combustion heater 130 in a first position. The first position is the position in which the combustion heater 130 is installed in the AHU 100 and is ready for operation. The combustion heater 130 in the installed position is ready for operating to direct combustion gases through the heat exchanger tubes 136 and heats the air as it flows through the fan section 104. The first position can also be referred to as the installed position. FIG. 3 also shows the combustion heater 130 in its installed position.

As shown in FIG. 7A, the channels 144A, 144B each extend between the front side 112 and the rear side 118 of the AHU 100. Each of the channels 144A, 144B extending towards the opening 128 in the front side 112 of the AHU 100. As shown in FIG. 7A, each of the channels 144A, 144B extends along its respective side wall 140, 142 in a direction towards the opening 128 in the front side 112 of the AHU 100. The end 147 of each channels 144A, 144B that faces towards the front side 112 is open. The brackets 146A, 146B also each extending in the depth direction (e.g., direction $D_1$) of the fan section 104.

FIG. 7B shows the combustion heater 130 in a second position. The second position is a position in which the combustion heater 130 is partially slidably removed from the AHU 100. For example, the combustion heater 130 in FIG. 7A is slidably moved (e.g., pulled) through the opening 128 in the front side 112 of the AHU 100 to reach the second position shown in FIG. 7A. The combustion heater 130 is slidably moved in the direction $D_3$ from the first position (shown in FIG. 7A) into the second position (shown in FIG. 7B). The second position may allow, for example, a technician to more easily access and/or work on the combustion heater 130.

FIG. 7C shows the combustion heater 130 in a third position. The third position is a position in which the combustion heater 130 is completely removed from the AHU 100. For example, the combustion heater 130 in FIGS. 7A and 7B is slidably moved (e.g., pulled) through the opening 128 in the front side 112 of the AHU 100 to reach the third position shown in FIG. 7C. The combustion heater 130 slidably moved in the direction $D_3$ from the second position (shown in FIG. 7B) into the second position (shown in FIG. 7C). In the removed position (shown in FIG. 7D), the combustion heater 130 is completely separated from the AHU 100.

In removing the combustion heater 130 from the AHU 100 (e.g., moving the combustion heater 130 into the completely removed position shown in FIG. 7C), the slidable tube support 150 slides out of the channels 144A, 144B. The retaining member 152 sliding out of the ends 147 of the channels 144A, 144B. This allows for easy removal of the combustion heater 130 from the AHU 100 by simply pulling it in the third direction $D_3$ from the AHU 100. The slidable tube support 150 is configured to support the installed combustion heater 130 (e.g., vertically support the heat exchanger tubes 136 within the fan section 104) while also allowing slidable movement and removal of combustion heater 130 from the AHU 100. In an embodiment, the slidable tube support 150 is slidable in the depth direction $D_3$ such that is does not restrict movement of the combustion heater 130 along the depth direction $D_3$.

In an embodiment, a slidable tube support system for an AHU 100 includes one or more of the slidable tube supports 150. In an embodiment, the slidable tube support system for an AHU 100 includes one or more of the slidable tube supports 150 and one or more adjacent tube support clips 170. For example, the slidable tube support system may include a plurality of the adjacent tube support clips 170.

Figure 8:
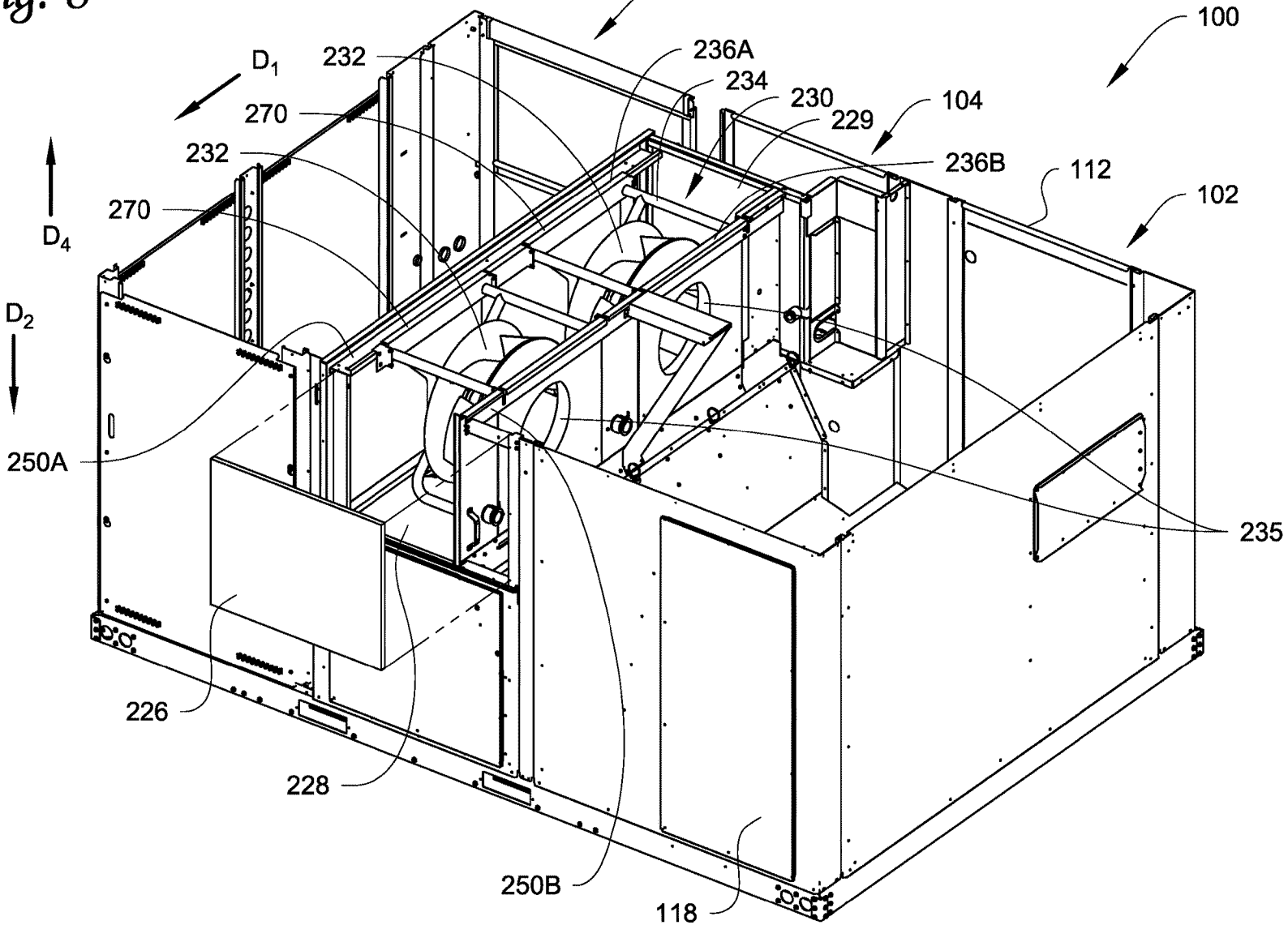
FIG. 8 is a rear perspective view of an embodiment of an AHU.

FIG. 8 is a rear perspective view of an embodiment of an AHU 100. A panel 226 of the rear side 118 is opened and removed in FIG. 9. The panel 226 covers an opening 228 in the rear side 118 of housing 110 for the fan section 104 of the AHU 100. The opening 228 in the housing 228 can be for an upper portion of the fan section 104. The top side 120 of the housing 110 of the AHU 100 (e.g., top side 120 in FIG. 2) in FIG. 8 is also removed for illustration. For example, a panel 227 (shown in FIG. 2) of the top side 120 is opened and removed in FIG. 8. The panel 227 covers an opening 229 in the top side 120 of the housing 110 for the fan section 104 of the AHU 100. In particular, the opening 229 is for the top of the fan section 104.

The AHU 100 includes a fan assembly 230. The fan assembly 230 operates to generate air flow through the housing 110 from the inlet 108A to the outlet 108B (obscured in FIG. 8), as discussed above. The fan assembly 230 one or more fan(s) 232 and a fan frame 234. The fan(s) 232 affixed to the fan frame 234. For example, the fan frame 234 provides a support frame for the fan(s) 232. As shown in FIG. 8, the fan(s) of the fan assembly 230 are radial fan(s). A radial fan has an axial inlet and at least one radial outlet. The radial fan axially suctioning air into its blade and discharging the air in one or more radial direction(s). The shape of the fan section 104 can direct the air downward towards the heat exchanger tubes 136 and the outlet 108B.

The fan(s) 232 are configured to suction air from the inlet section 102 into the combustion suction 104. As shown in FIG. 8, the fan frame 234 can also define an inlet 235 for each fan(s) 232 to suction air from the inlet section 102. During operation of the AHU 100, fan(s) 232 generates the flow of air through the inlet section 102 and the fan section 104 as discussed above. In particular, the fan assembly 230 can be configured to blow air so that the air flows downward from the fan assembly 230 and across the heat exchanger tubes 136 of the combustion heater 130 (e.g., air flows downward in direction $D_2$ across the heat exchanger tubes 136 as shown in FIG. 4). For example, the suction of the fan(s) 232 pulls air through the inlet 108A (obscured in FIG. 8) into inlet section 102 and blows the air past the heat exchanger tubes 136 and out through the outlet 108B in the fan section 104.

The housing 110 includes a pair of rails 250A, 250B for supporting the fan assembly 230. The rails 250A, 250B disposed in the fan section 104. Each of the rails 250A, 250B has a length L that extends between the front side 112 and the rear side 118 of the housing 110. For example, the rails 250A, 250B each extending away from the opening 228 into the fan section 104. The fan frame 234 includes a pair of grooves 236A, 236B. The grooves 236A, 236B configured to be placed on the rails 250A, 250B to couple the fan assembly 230 to the housing 110.

FIG. 8 shows the fan assembly 230 in a first position. The first position is the installed position of the fan assembly 230. The fan assembly 230 in its installed position is ready for operating to blow air from the inlet section 102 downward towards the heat exchanger tubes 136 of the combustion heater 130. The fan assembly 230 is configured to be both slidably and liftably removable from the AHU 100 as discussed below. For example, the disposition of the grooves 236A, 236B of the fan assembly 230 to the rails 250A, 250B is configured to vertically support the fan assembly 230 within the AHU 100 while also allowing lifting and horizontal sliding of the fan assembly 230 sufficient to remove the fan assembly from the AHU 100. In an embodiment, the AHU 100 can include one or more the sliding block(s) 270. The sliding block(s) 270 are discussed in more detail below.

Figure 9:
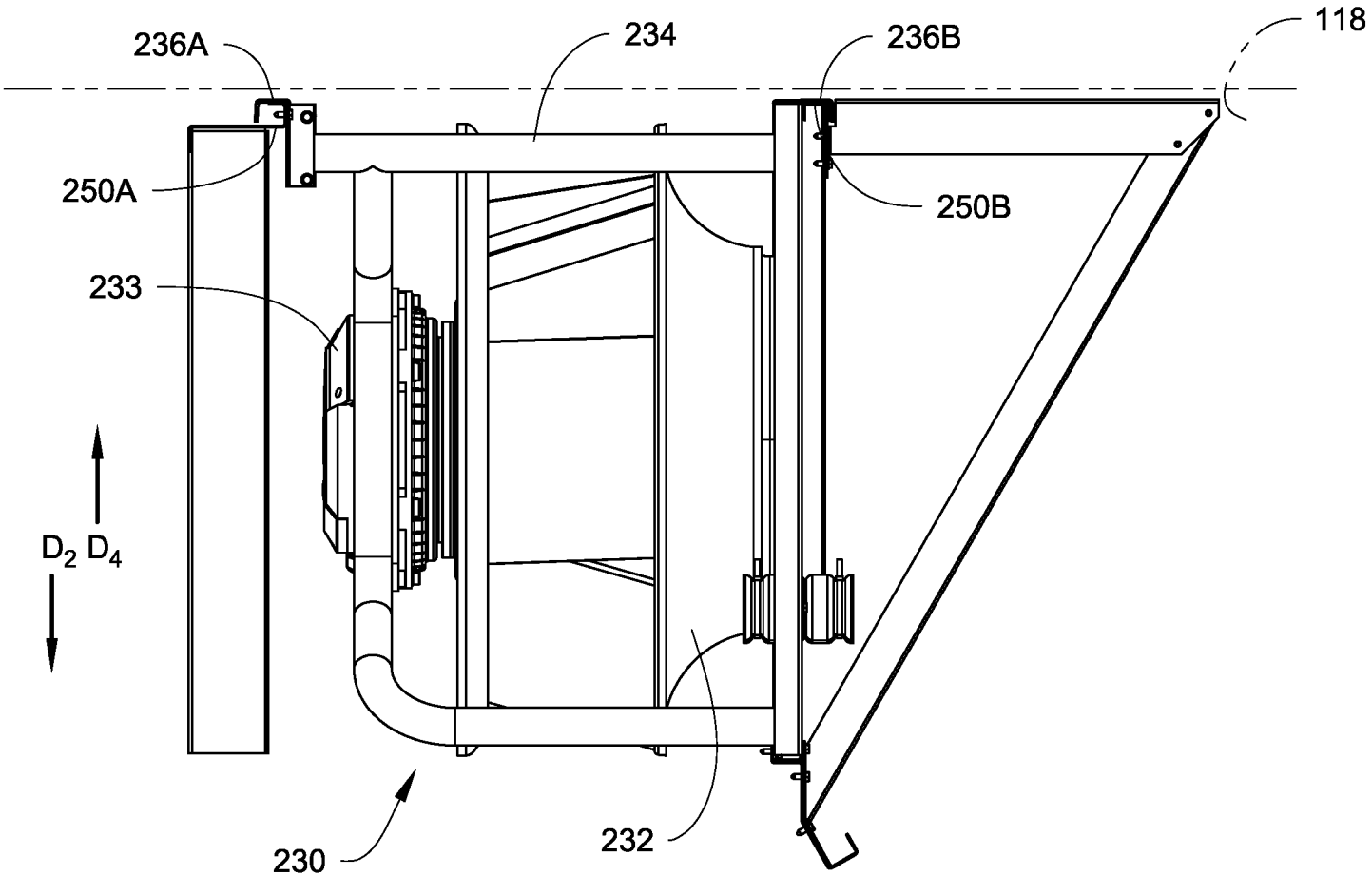
FIG. 9 shows a rear view of a fan assembly and rails for supporting the fan assembly within the AHU of FIG. 8, according to an embodiment.

FIG. 9 shows a rear view of the fan assembly 230 disposed on the rails 250A, 250B. A portion of the top side 120 of the housing 110 that extends along the fan section 104 is illustrated in dashed lines in FIG. 9 for illustration purposes. The fan assembly 230 hangs from the rails 250A, 250B. The fan assembly 230 is slidable on the rails 250A, 250B. The grooves 236A, 236B disposed on the rails 250A, 250B such that the fan assembly 230 is slidably supported within AHU 100. The configuration of the grooves 236A, 236B disposed on the rails 250A, 250B also allows for the fan assembly 230 to be lifted off of the rails 250A, 250B (e.g., does not limit upward movement of the fan assembly 230)

As shown in FIG. 9, the fan 232 includes an electrical motor 233. The electrical motor 233 that drives the fan 232. The AHU 100 can include one or more electrical wires (e.g., power supply wire(s), signal wire(s), and the like) (not shown) for operating the fan(s) 232. The removal of the fan assembly 230 can include electrically decoupling the fan assembly 230 from the rest of the AHU 100. For example, electrically decoupling the fan assembly 230 from the AHU 100 can include disconnecting the electrical wire(s) for the combustion heater 130.

As shown in FIG. 9, each of the rails 250A, 250B project upwards (e.g., in direction $D_4$) towards the top side 120 of the housing 110. For example, the rails 250A, 250B project upwards in the direction $D_4$. The rails 250A, 250B shown in FIG. 9 project directly upward. In an embodiment, rails 250A, 250B may project upwards at an angle. In an embodiment, the grooves 236A, 236B of the fan assembly 230 are slotted onto the rails 250A, 250B of the housing 110. For example, a first groove 236A is slotted onto a first rail 250A and a second groove 236B is slotted onto the second rail 250A.

As shown in FIG. 9, the grooves 236A, 236B face downward away from the top side 120 of the housing 110. For example, the grooves 236A, 236B face downwards in the direction $D_2$. The grooves 236A, 236B shown in FIG. 9 face directly downwards. In an embodiment, the grooves 236A, 236B may face downwards at an angle. Each groove 236A, 236B forms a space that is enclosed on at least two sides. The grooves 236A, 236B as shown in FIG. 9 are enclosed on at least three sides. For example, the space in the grooves 236A, 236B in FIG. 9 are enclosed by a first side wall that extends upwardly, a second side that extends outwardly from the first side, and a third side that extends downwardly from the second side. This provides the grooves 236A, 236B with a U shaped cross section. The grooves 236A, 236B can hook over each of the rails 250A, 250B so as to also provide rigid support between the two rails 250A, 250B. For example, the grooves 236A, 236B being hooked over each of the rails 250A, 250B allows the fan assembly 230 to prevent the rails 250A, 250B from bowing away from each other.

In an embodiment, a groove 236A can be enclosed on just two sides. For example, the grooves 236A, 236B may not include the third side. In such an embodiment, the space formed by the groove 236A, 236B can be the space formed in the corner of the two intersecting sides. The groove in such an embodiment can be formed by a flange that extends horizontally outward from the fan frame 234.

The fan assembly 230 is supported within the housing 110 so as to be liftably removable. The fan assembly 230 has a configuration that allows for the fan assembly 230 in its install position to be lifted (e.g., moved vertically upward in direction $D_4$) out of the AHU 100 and its housing 110. The liftably removable configuration of the fan assembly 230 allows for the fan assembly to be lifted from its install position to a position entirely outside of the AHU and its housing 110. When the fan assembly 230 is to be removed (e.g., for repair, testing, replacement, and the like), the fan assembly 230 is configured from its installed position to liftable/movable in the upward direction $D_4$ to pass through the opening 229 in the top side 120 of the housing 110 to be entirely outside of the AHU 100 and its housing 110.

Figure 10:
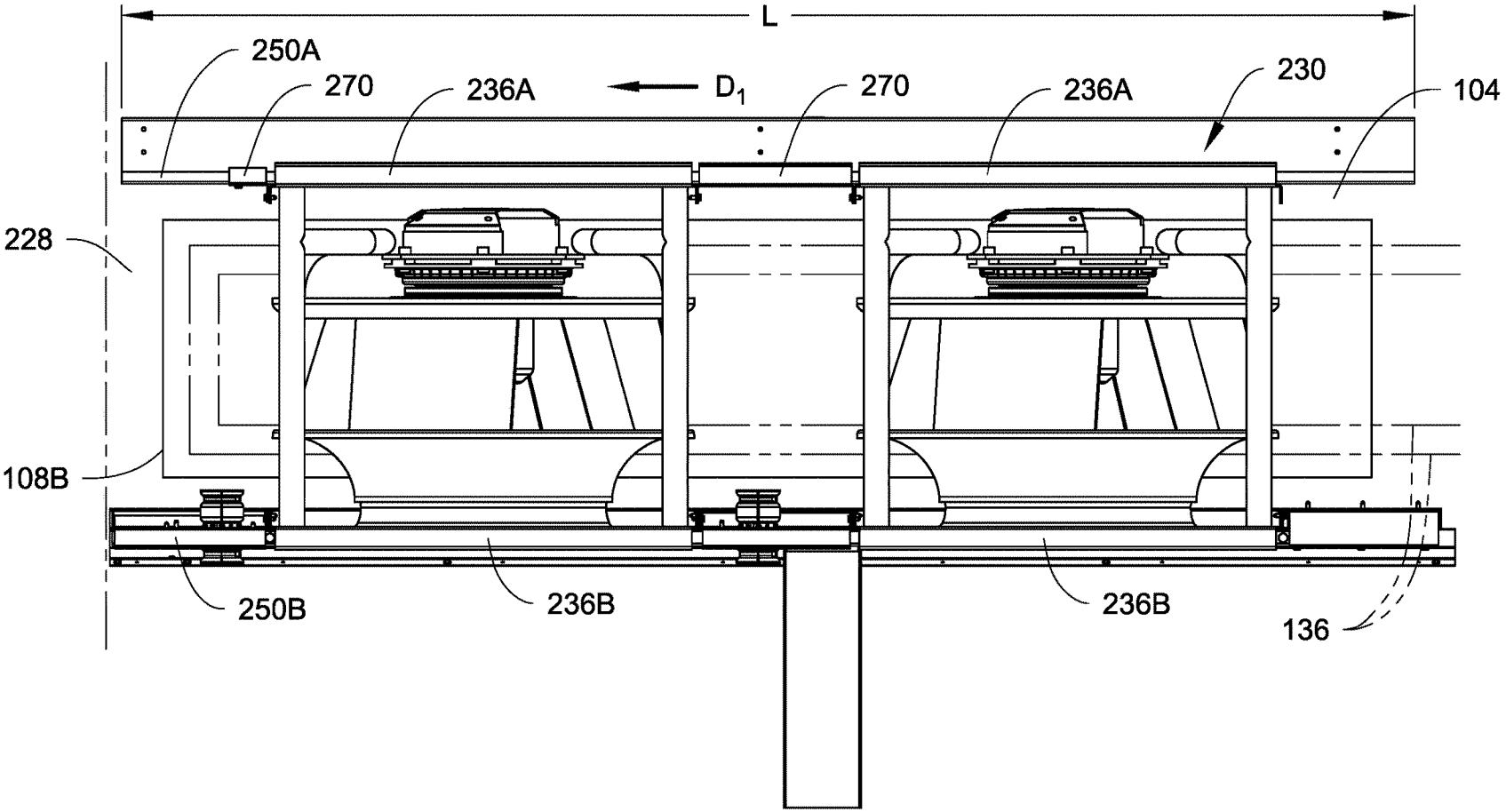
FIG. 10 shows a partial top view of the fan assembly in a fan section of the AHU of FIG. 8, according to an embodiment.

FIG. 10 shows a partial top view of the fan assembly 230 disposed in the fan section 104, according to an embodiment. The general position of the heat exchanger tubes 136 is schematically illustrated with dashed lines in FIG. 10. The general position of the outlet 108A is also illustrated in FIG. 10.

As similarly discussed above, the grooves 236A, 236B of the fan assembly 230 are slidably disposed on the rails 250A, 250B of the housing 110. The grooves 236A, 236B are slidably disposed on the rails 250A, 250B such that the fan assembly 230 is slidable along the rails 250A, 250B. For example, the supported fan assembly 230 is configured to be slidable along the length L of the rails 250A, 250B in the direction $D_1$ towards the opening 228 in the housing 110. The fan assembly 230 slides along the rails 250A, 250B to move the fan assembly 230 through the opening 228 in housing 110.

As shown in FIG. 10, the grooves 236A, 236B are disposed on opposite sides of the fan frame 234. For example, the first groove 236A is located along the rear of the fan frame 234 and the second groove 236B is disposed along the front of the fan frame 234. The grooves 236A, 236B in FIG. 10 have multiple sections. For example, the first groove 236A is non-continuous and has multiple sections disposed on the first rail 250A, 250B. In an embodiment, the grooves 236A, 236B may each have one or more sections.

The fan assembly 230 is slidably removable by having a configuration that allows for the fan assembly 230 to be slide from its installed position to a position outside of the AHU 100 and its housing 110. For example, the fan assembly 230 from its installed position is slidable in the horizontal direction (e.g., in the direction $D_1$) to an extent that allows for the fan assembly 230 to be moved entirely outside of the AHU 100 and its housing 110.

In an embodiment, the AHU 100 may include one or more sliding block 270. The sliding block(s) 270 restrict the sliding movement of the fan assembly 230 along the rails 250A, 250B. A sliding block 270 is disposed in the sliding path of the fan assembly 230. The sliding block 270 limits the sliding of the fan assembly 230 along the rails 250A, 250B. For example, the groove 236A contacts the sliding block 270 and is stopped from sliding further in the direction D1. As shown in FIG. 10, a sliding block 270A can be provided along one of the rails 250A, 250B between the fan assembly 230 and the opening 228 and/or between sections of one of the grooves 236A, 236B.

Operation of the AHU 100 can shake the fan assembly 230. The operation of the fan(s) 232 can also apply directional forces to the fan assembly 230. For example, operation of the fan(s) can apply a force in the first direction D1 to the fan assembly 230. The sliding block(s) 270 can be used to limit/prevent sliding of the fan assembly 230 in their installed position during operation of the AHU 100. For example, the sliding block(s) 270 preventing incidental sliding of the fan assembly 230 not related to removal of the fan assembly 230 (e.g., forces not applied by a technician (directly or mechanically) for sliding the fan assembly 230). In an embodiment, the sliding removal of the fan assembly 230 can include detaching the slide blocks 270 to allow the full sliding movement and removal of the fan assembly 230.

Figure 11:
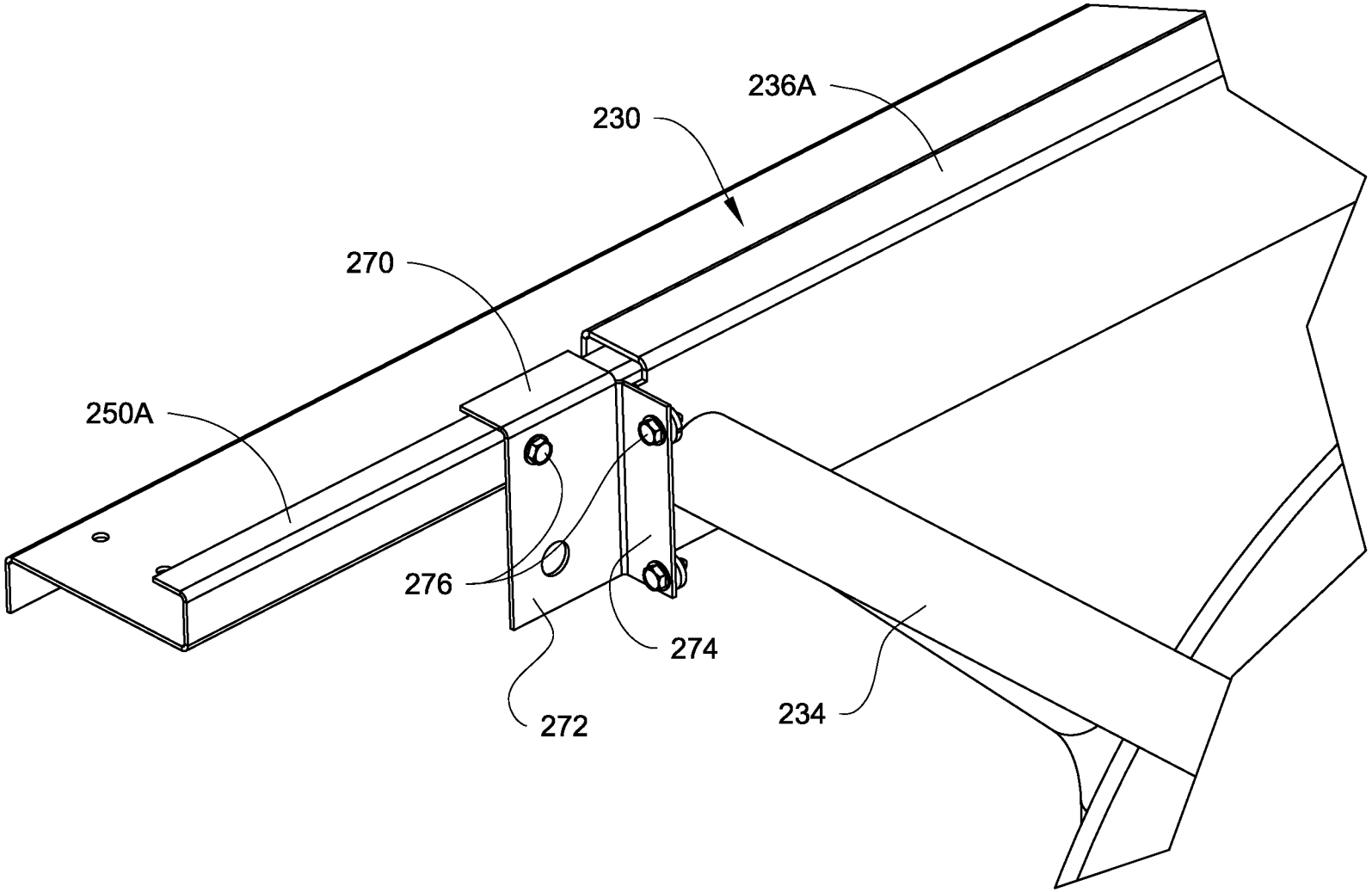
FIG. 11 is a rear perspective exploded view of a sliding block section disposed in a fan section of the AHU of FIG. 8, according to an embodiment.

FIG. 11 is a rear perspective exploded view of a sliding block 270 for the fan assembly 230, according to an embodiment. The sliding block 270 is configured to be detachably affixed to the housing 110 and/or to the fan assembly 230. The sliding block 270 can have a first side 272 that is detachably affixed to the housing 110. As shown in FIG. 11, the first side 272 may be detachably affixed to the one of the rails 250A, 250B via a fastener 276 (screw, bolt, clamp, and the like). The sliding block 270 can have a second side 274 that is detachably affixed to the fan assembly 230. For example, the second side 274 is detachably affixed to the fan frame 234 via a fastener 276 (e.g., screw, bolt, clamp, and the like), coupling, or the like. When the fan assembly 230 is to be removed, the sliding block 270 is detached from the fan assembly 230 and/or the housing 110. In an embodiment, sliding removal of the fan assembly 230 can include removing one or more of the fasteners 276 to detach the sliding block 270 (e.g., unscrewing, pulling out, removing, and the like) from fan assembly 230 and/or the housing 110.

Figure 12:
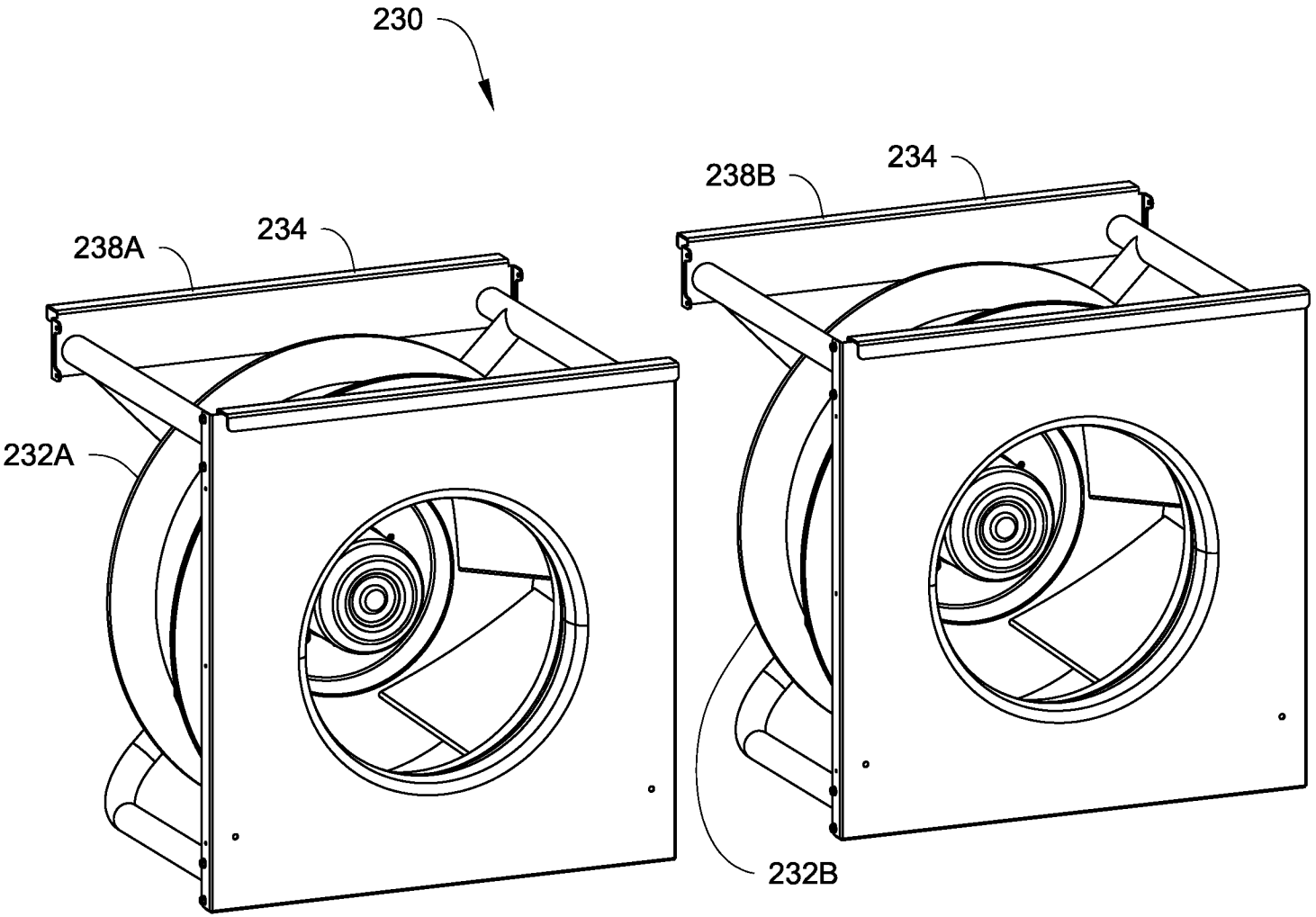
FIG. 12 is a top perspective view of an embodiment of a fan assembly for an AHU.

FIG. 12 shows the separation of the fan assembly 230. In an embodiment, the fan frame 234 of the fan assembly 230 is configured to be separable into multiple separate portions 238A, 238B as shown in FIG. 12. Each of the portions 238A, 238B includes at least one fan 232. The portions 238A, 238B can be coupled together via one or more removable fasteners (not shown) (e.g., screw, bolt, clamp, and the like). For example, the fan frame 234 is separable into a first frame portion 238A that includes a first fan 232A and a second frame portion 238B that includes a second fan 232B. The fan assembly 230 is separable into two portions in FIG. 12. In an embodiment, the fan assembly 230 may include more than two fans 232 and be separable into more than two frame portions 238A, 238B. For example, the fan assembly 230 in an embodiment may include three or more fans 232 and be separable into three or more portions.

Figure 13A:
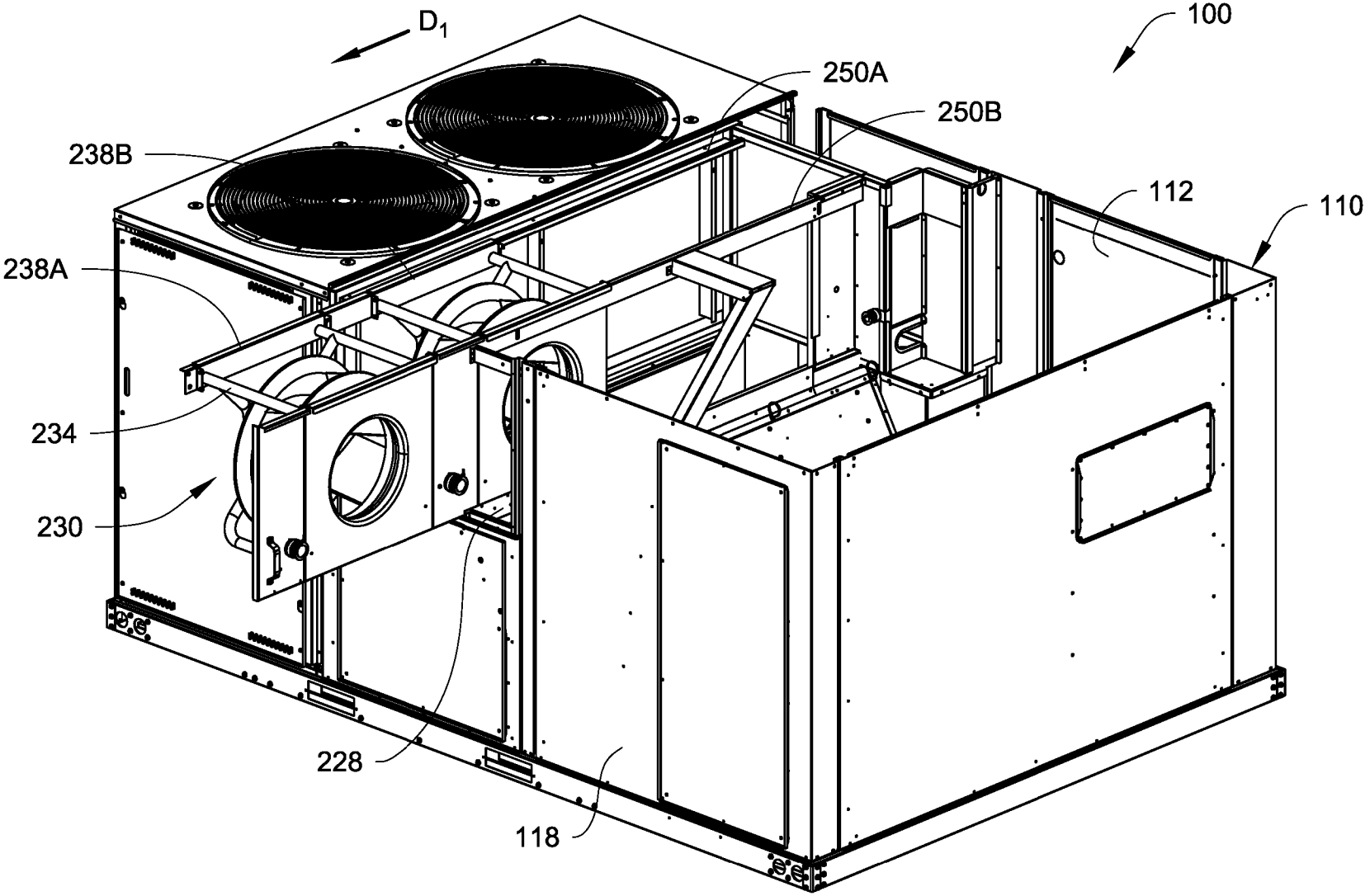
FIGS. 13A-13C show the fan assembly of the ABU in FIG. 8 in various positions.
Figure 13B:
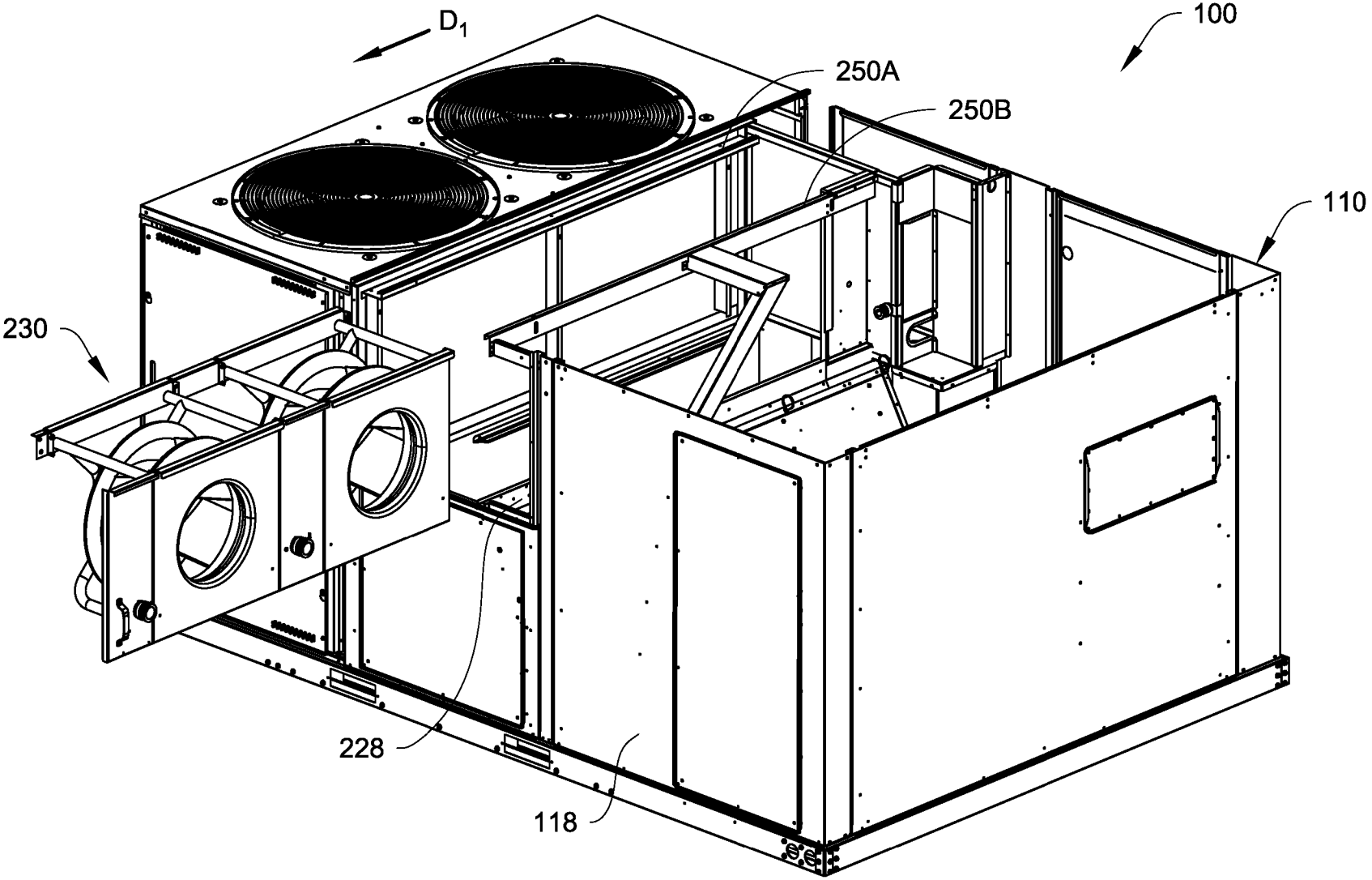
Figure 13C:
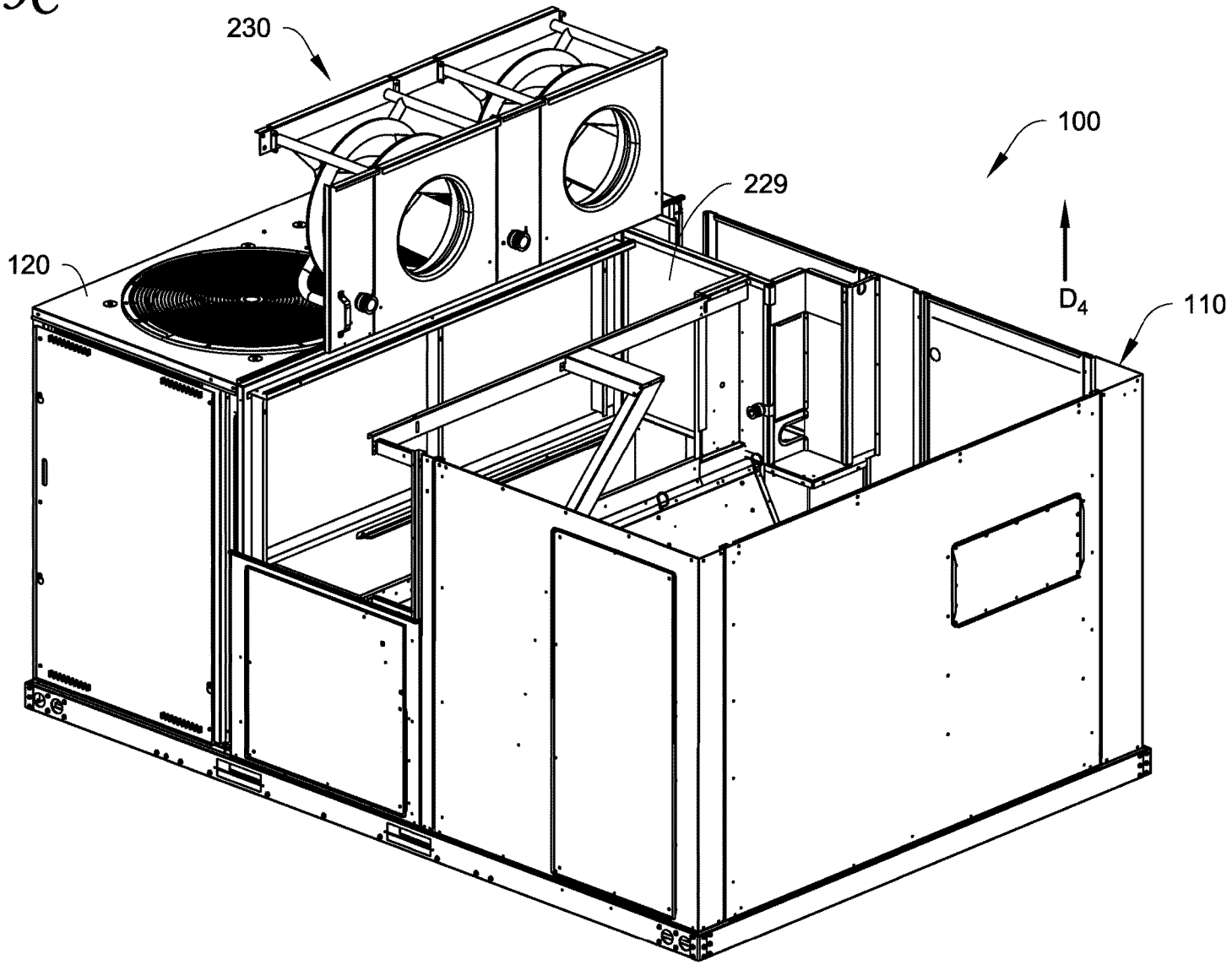

FIGS. 13A-13C show the fan assembly 230 in various positions during removal from the AHU 100. FIGS. 13A and 13B shows the fan assembly 230 when slidably removed from the AHU 100. FIG. 13C shows the fan assembly 230 when liftably removed from the AHU 100. As noted above, FIG. 8 shows the fan assembly 230 in the first position, which is its installed position.

FIG. 13A shows the fan assembly 230 in a second position. The second position is a position in which fan assembly 230 is partially slidably removed from the AHU 100. For example, fan assembly 230 in FIG. 8 is slidably moved (e.g., pulled) through the opening 228 in the rear side 118 of the AHU 100 to reach its second position as shown in FIG. 13A. The fan assembly 230 is slidably moved along the rails 250A, 250B in the direction $D_1$ from the first position (shown in FIG. 8) into the second position (shown in FIG. 13A). The second position may allow, for example, a technician to more easily access and/or work on the fan assembly 230.

As shown in FIG. 13A, the first fan portion 238 is positioned outside of the AHU 100 when the fan assembly 230 is in the second position. In an embodiment, the second position allows for the first fan portion 238 to be detached and separated from the AHU 100. For example, the first fan portion 238A is disposed outside the AHU 100 which can allow the first fan portion 238A to be separated from the rest of the fan assembly 230 (e.g., can allow the first fan portion 238A to be separated from the second fan portion 238B). The second position may advantageously allow, for example, a technician to remove the first fan portion 238A when there is limited room along the rear side 118 of the housing 110 (e.g., the rear side 118 is close to the side of a building, another AHU, or the like).

FIG. 13B shows the fan assembly 230 in a third position. The third position is a position in which fan assembly 230 is completely slidably removed from the AHU 100. For example, the fan assembly 230 in FIG. 8 and/or FIG. 13A is slidably moved (e.g., pulled) through the opening 228 in the rear side 118 of the AHU 100 to reach the third position shown in FIG. 13B. The fan assembly 230 slidably moved in the direction $D_1$ from the first position (shown in FIG. 8) to the third position (shown in FIG. 13B). The fan assembly 230 reaching and being moved from the second position (shown in FIG. 13A) as the fan assembly 230 is moved from the first position (shown in FIG. 8) to the third position (shown in FIG. 13B). The second position in FIG. 13A can be an example of an intermediate position between the installed position and the completely slidably removed position. In the removed position (shown in FIG. 13B), the fan assembly 230 is completely separated from the AHU 100.

The fan assembly 230 is configured to slide through an opening 228 in the rear side 118 of AHU 100. In an embodiment, the sliding direction/removal direction of the fan assembly 230 may be invested. For example, the AHU 100 in an embodiment may be configured to have the fan assembly 230 configured to be slidably move through an opening in the front side 112 of housing 110 instead of the rear side 118.

FIG. 13C shows the fan assembly 230 in a fourth position. The fourth position in FIG. 13C is a position in which fan assembly 230 is completely liftably removed from the AHU 100. The fourth position can be referred to as a completely liftably removed position. For example, fan assembly 230 in the installed position (as shown in FIG. 8) is moved upwardly (e.g., lifted, pulled upwards) through the opening 229 in the top side 120 of the AHU 100 to reach the fourth position shown in FIG. 13C. The fan assembly 230 is lifted/moved in the direction $D_4$ from the first position (shown in FIG. 8) into the fourth position (shown in FIG. 13C).

When fan assembly 230 is configured to be capable of being both slidably removable and liftably removable from the AHU 100. For example, the fan assembly 230 in the first position (as shown in FIG. 8) is capable of sliding out of the AHU 100 to be removed and is capable of being lifted out of the AHU 100 to be removed. This duel removability of the fan assembly 230 advantageously allows removal through two different sides of AHU 230. This can be advantageous when one side of an installed AHU is close to another object (e.g., a portion of a building, another AHU, and the like) that does not allow for removal through said side.

In an embodiment, the removable configuration of the fan assembly 104 may be employed in AHU 100 that does not include a combustion heater. For example, in such an embodiment, the AHU 100 may be configured to utilize a non-combustion type of heater or to not have a heating mode. In an embodiment, the removable configuration of the combustion unit 130 may be employed in an AHU 100 that does not utilize the liftably and slidably removable fan assembly. In such an embodiment, the AHU 100 may employ a conventional fan configuration for directing air through the fan section 104.

ASPECTS

Any of aspects 1-11 can be combined with any of aspects 12-18.

Aspect 1. An air handling unit for a heating, ventilation, air conditioning, and refrigeration system, the AHU comprising: a housing containing a combustion section, the housing including a first side having an opening for the combustion section, the combustion section having a first side wall with a first channel and a second side wall with a second channel, the first side wall disposed opposite of the second side wall; a combustion heater disposed within the housing, the combustion heater including: an end plate, heat exchanger tubes extending from the end plate and into the combustion section, and a tube support supporting the heat exchanger tubes within the combustion section, the tube support slidably disposed in the first channel and the second channel, wherein the tube support configured to slidably move through the first channel and the second channel in a first direction that moves the combustion heater through the opening in the housing.

Aspect 2. The air handling unit of aspect 1, wherein the tube support configured to slidably move in the first direction through and from the first channel and the second channel such that the combustion heater is entirely moved through the opening in the housing.

Aspect 3. The air handling unit of any one of Aspects 1 or 2, wherein the first channel and the second channel each have an open end, the tube support having a retaining member slidably disposed in the first channel and the second channel, and movement of the retaining member in the first direction through the open ends of the first channel and the second channel separates the combustion heater from the housing.

Aspect 4. The air handling unit of any one of Aspects 1-3, wherein the first channel and the second channel do not limit movement of the tube support in the first direction.

Aspect 5. The air handling unit of any one of Aspects 1-4, wherein the tube support includes a retaining member, the retaining member having a first end disposed in the first channel and a second end disposed in the second channel.

Aspect 6. The air handling unit of Aspect 5, wherein tube support includes a vertical support extending from the retaining member, and a plurality of contact arms each extending from the vertical support, the heat exchanger tubes each resting on a respective one of the plurality of contact arms.

Aspect 7. The air handling unit of Aspect 6, wherein each of the contact arms extending between a vertically adjacent pair of the heat exchanger tubes.

Aspect 8. The air handling unit of any one of Aspects 1-7, wherein the tube support vertically supports the heat exchanger tubes within the combustion section.

Aspect 9. The air handling unit of any one of Aspects 1-8, wherein the first channel and the second channel restricting vertical movement of the tube support while allowing the tube support to move in the first direction.

Aspect 10. The air handling unit of any one of Aspects 1-9, the first channel and the second channel formed by a pair of brackets provided on opposite walls of the combustion section.

Aspect 11. The air handling unit of any one of Aspects 1-10, further comprising: one or more support clips, each of the support clips fitted around a vertically adjacent pair of the heat exchanger tubes.

Aspect 12. An air handling unit for a heating, ventilation, air conditioning, and refrigeration system, the air handling unit comprising: a housing containing a combustion section, the housing including: a first side with a first opening for the combustion section, a top side with a second opening for the combustion section, and a pair of rails disposed in the combustion section, a fan assembly disposed in the combustion section, the fan assembly including one or more fans and a pair of grooves, the pair of grooves slidably disposed on the pair of rails, wherein the fan assembly is configured to be both slidably removable from the AHU through the first opening in the housing and liftably removable from the AHU through the second opening in the housing.

Aspect 13. The air handling unit of Aspect 12, wherein the fan assembly is configured to be: slidable along the pair of rails in a first direction to move the fan assembly through the first opening, and liftable from the pair of rails in a second direction to move the fan assembly through the second opening, the first direction and second direction being different.

Aspect 14. The air handling unit of any one of Aspects 12 or 13, wherein the second direction is an upward direction.

Aspect 15. The air handling unit of any one of Aspects 12-14, wherein the pair of grooves includes a first groove disposed on a first side of the fan assembly and a second groove disposed on a second side of the fan assembly opposite the first side.

Aspect 16. The air handling unit of any one of Aspects 12-15, wherein the pair of grooves face downward and the pair of rails project upwards.

Aspect 17. The air handling unit of any one of Aspects 12-16, wherein the fan is a radial fan.

Aspect 18. The air handling unit of any one of Aspects 12-17, further comprising: a heater disposed in the fan section, the one or more fans of the fan assembly configured to blow air towards the heater.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. An air handling unit (AHU) for a heating, ventilation, air conditioning, and refrigeration system, the air handling unit comprising:

a housing including a combustion section and a pair of channels respectively extending along a length of the combustion section; and a combustion heater including heat exchanger tubes disposed in the combustion section and a tube support supporting the heat exchanger tubes within the combustion section, the heat exchanger tubes resting on the tube support, the tube support including a retaining member, the tube support configured to slidably move in the pair of channels to move the heat exchanger tubes through an opening in the housing, and the retaining member having a first end disposed in a first channel of the pair of channels and a second end disposed in a second channel of the pair of channels.

2. The air handling unit of claim 1, wherein the tube support configured to slidably move in a first direction in the pair of channels such that the combustion heater is entirely moved through the opening in the housing.

3. The air handling unit of claim 2, wherein the pair of channels do not limit movement of the tube support in the first direction.

4. The air handling unit of claim 1, wherein the pair of channels each have an open end, the retaining member slidably disposed in the pair of channels, and movement of the retaining member in a first direction through the open ends of the pair of channels separates the combustion heater from the housing.

5. The air handling unit of claim 1, wherein the tube support includes a vertical support extending from the retaining member, and a plurality of contact arms each extending from the vertical support, the heat exchanger tubes each moveably resting on a respective one of the plurality of contact arms.

6. The air handling unit of claim 5, wherein each of the contact arms extending between a vertically adjacent pair of the heat exchanger tubes.

7. The air handling unit of claim 1, wherein the tube support vertically supports the heat exchanger tubes within the combustion section.

8. The AHU of claim 1, wherein the pair of channels restrict vertical movement of the tube support while allowing the tube support to move in a first direction towards the opening in the housing.

9. The AHU of claim 1, wherein the pair of channels are formed by a pair of brackets provided on opposite walls of the combustion section.

10. The AHU of claim 1, further comprising:

one or more support clips, each of the one or more support clips fitted around a vertically adjacent pair of the heat exchanger tubes.

11. An air handling unit (AHU) for a heating, ventilation, air conditioning, and refrigeration system, the air handling unit comprising:

a housing containing a fan section, the housing including: a first side with a first opening for the fan section, a top side with a second opening for the fan section, and a pair of rails disposed in the fan section; and a fan assembly disposed in the fan section, the fan assembly including one or more fans and a pair of grooves, the pair of grooves slidably disposed on the pair of rails, wherein the fan assembly is configured to be both slidably removable from the AHU through the first opening in the housing and liftably removable from the AHU through the second opening in the housing.

12. The AHU of claim 11, wherein the fan assembly is configured to be: slidable along the pair of rails in a first direction to move the fan assembly through the first opening, and liftable from the pair of rails in a second direction to move the fan assembly through the second opening, the first direction and the second direction being different.

13. The AHU of claim 12, wherein the second direction is an upward direction.

14. The AHU of claim 11, wherein the pair of grooves includes a first groove disposed on a first side of the fan assembly and a second groove disposed on a second side of the fan assembly opposite the first side.

15. The AHU of claim 11, wherein the pair of grooves face downward and the pair of rails project upwards.

16. The AHU of claim 11, wherein the one or more fans include a radial fan.

17. The AHU of claim 11, further comprising:

a heater disposed in the housing, the one or more fans of the fan assembly configured to blow air towards the heater.

18. An air handling unit (AHU) for a heating, ventilation, air conditioning, and refrigeration system, the air handling unit comprising:

a housing including a combustion section and a pair of channels respectively extending along a length of the combustion section; and a combustion heater including heat exchanger tubes disposed in the combustion section and a tube support supporting the heat exchanger tubes within the combustion section, the heat exchanger tubes at least one of moveably resting or directly resting on the tube support, the tube support including a retaining member, the tube support configured to slidably move in the pair of channels to move the heat exchanger tubes through an opening in the housing, and the retaining member having a first end disposed in a first channel of the pair of channels and a second end disposed in a second channel of the pair of channels.

* * * * *